US010087693B2

(12) United States Patent
Bye

(10) Patent No.: US 10,087,693 B2
(45) Date of Patent: Oct. 2, 2018

(54) MANIPULATION TOOL AND METHOD OF USING SAME, AND AN ADAPTER FOR USE TOGETHER WITH THE MANIPULATION TOOL

(71) Applicant: E Holstad Holding AS, Sola (NO)

(72) Inventor: Arnulf Bye, Bryne (NO)

(73) Assignee: E Holstad Holding AS, Sola (NO)

( * ) Notice: Subject to any disclaimer, the term of this patent is extended or adjusted under 35 U.S.C. 154(b) by 324 days.

(21) Appl. No.: 15/024,469

(22) PCT Filed: Sep. 24, 2014

(86) PCT No.: PCT/NO2014/050175
§ 371 (c)(1),
(2) Date: Mar. 24, 2016

(87) PCT Pub. No.: WO2015/047102
PCT Pub. Date: Apr. 2, 2015

(65) Prior Publication Data

US 2016/0215577 A1 Jul. 28, 2016

(30) Foreign Application Priority Data

Sep. 26, 2013 (NO) ..... 20131288

(51) Int. Cl.
*E21B 23/00* (2006.01)
*E21B 23/06* (2006.01)
*E21B 31/18* (2006.01)

(52) U.S. Cl.
CPC ..... *E21B 23/00* (2013.01); *E21B 23/06* (2013.01); *E21B 31/18* (2013.01)

(58) Field of Classification Search
CPC ..... E21B 23/06; E21B 31/18
See application file for complete search history.

(56) References Cited

U.S. PATENT DOCUMENTS 2,399,766 A 5/1946 Wendell
3,299,957 A * 1/1967 O'Neill ..... E21B 19/00 166/77.53

(Continued)

FOREIGN PATENT DOCUMENTS

CN 102791954 B 11/2012
CN 103233691 B 7/2013

(Continued)

*Primary Examiner* — Shane Bomar
(74) *Attorney, Agent, or Firm* — Gable Gotwals

(57) ABSTRACT

This invention relates to a manipulation tool and method for connection and operation of a controllable well device and adapter. The tool includes an elongated housing with first and second end portions, a gripping device in the first end portion provides releasable engagement with the well device controllable by means of the manipulation tool. The gripping device includes means for resisting rotational and axial movement between the housing and the well device. At least one manipulation device is axially displaceable between a first and second position along a longitudinal axis of the housing and rotatable around the longitudinal axis of the housing. A first driving device produces axial displacement of the at least one manipulation device, and a second driving device produces rotation of at least one manipulation device. The first and second driving devices are connected to a control unit for controlling energy to the driving devices.

21 Claims, 18 Drawing Sheets

(56) References Cited

U.S. PATENT DOCUMENTS

| | | | | |
|---|---|---|---|---|
| 3,490,550 | A * | 1/1970 | Horton | E02F 3/90 175/213 |
| 3,491,842 | A * | 1/1970 | Castela | E21B 7/124 175/171 |
| 8,210,251 | B2 * | 7/2012 | Lynde | E21B 23/14 166/55.7 |
| 8,333,219 | B2 | 12/2012 | Holstad | |
| 2004/0026090 | A1 * | 2/2004 | McGlothen | E21B 23/01 166/380 |
| 2005/0056427 | A1 | 3/2005 | Clemens et al. | |
| 2006/0090900 | A1 | 4/2006 | Mullen et al. | |
| 2008/0135293 | A1 | 12/2008 | Tashiro et al. | |
| 2011/0277986 | A1 | 11/2011 | Purkis | |
| 2014/0014364 | A1 * | 1/2014 | Noffke | E21B 17/043 166/377 |

FOREIGN PATENT DOCUMENTS

| | | |
|---|---|---|
| GB | 2300441 | 11/1996 |
| WO | 20050068775 | 7/2005 |
| WO | 328302 | 1/2010 |

* cited by examiner

MANIPULATION TOOL AND METHOD OF USING SAME, AND AN ADAPTER FOR USE TOGETHER WITH THE MANIPULATION TOOL

CROSS-REFERENCE TO RELATED APPLICATIONS

This United States application is the National Phase of PCT Application No. PCT/NO2014/050175 filed 24 Sep. 2014, which claims priority to Norwegian Patent Application No. 20131288 filed 26 Sep. 2013, each of which is incorporated herein by reference.

BACKGROUND OF THE INVENTION

The present invention relates to a manipulation tool for use in a bore such as an oil, gas or geothermal well or in some other pipe. More particularly, the invention relates to a manipulation tool for connection to and operation of a controllable well device which is in or is to be moved into a pipe connection during or after the installation of this. The well device may be, but is not restricted to, for example a mechanical plug, a valve, a so-called liner hanger or a zone-isolation packer which is also called a straddle packer in the specialist environment.

A person skilled in the art will know that some of the well devices mentioned may be installed temporarily, whereas others are permanently installed. Some of the well devices must allow operation or manipulation thereof after installation.

A person skilled in the art will further know that prior-art well devices are typically operated by the use of a piston-and-cylinder arrangement to apply axial, tensile or compressive force to a setting tool activated from the well surface. Such forces may typically be supplied from the surface with the help of means that in the specialist environment are referred to as battery packs, hydrostatic pressure, nitrogen chambers, and/or by means of explosives or pyrotechnical means. In the cases in which forces are not supplied directly from the surface, a so-called timer may typically be used, or a signal may be sent that, by means of an electric pulse, will initiate the release of stored forces based on pressure, trigger battery operation, detonate explosives or deflagrate pyrotechnical means. Other starting methods may be controlled by temperature, by mechanical influence, be pressure-activated or by sequences being run, in which the position of the well device is changed in a particular interval of the well. If battery operation is utilized to supply axial forces, this is often in combination with an electric motor and a hydraulic system, as will be known to a person skilled in the art and therefore is not described any further in this document.

The manipulation tool according to the present invention is particularly suitable for use in a well in the petroleum industry and in the geothermal industry. One of the purposes of the manipulation tool is to provide a tool which gives possibilities of repetitive use, and controlled monitoring by the operator to a far greater extent than with methods known today. The invention will also give new possibilities for utilization in other connections in which there is a need to operate equipment in a bore. It will therefore be understood that even if the description that follows is directed largely towards an operation in a well in the petroleum industry, the invention is not restricted to this only. Said operation includes the installation, operation, and control of equipment installed, such as opening and closing an installed plug, valve, and installing, removing or modifying downhole equipment temporarily or permanently installed.

The valve may also be a well plug according to the patents NO328302 and U.S. Pat. No. 8,333,219, the development of which the present applicant is involved in. The patents mentioned describe a well plug which may be set and pulled repeatedly during one and the same operation started in a well.

It is known to operate a runner valve or a so-called "sliding sleeve" by using hydraulic power which is supplied through hydraulic lines, by using tension or compression applied by means of a drill string, by using tension applied by means of a cable, or by using pressure applied to the valve by a steel ball or a so-called "dart" being pumped into the well and hitting the valve. The steel ball has been adapted to a ball seat in the valve. When the steel ball settles in the ball seat of the valve by means of gravity, a pressure-tight seal will form. To open the valve, pumping will be run against the steel ball, as will be known to a person skilled in the art. A dart has the same purpose as the steel ball, but is formed with one or more rubber fins which make it easy to pump down to the valve. At the tip of the dart there will typically be a nose with a sealing surface that complementarily fits an opposite sealing surface in the valve.

Valves may be left idle in the well for a long time without being operated. In consequence of this, the valve may "stick" and thereby become a challenge to operate. At the same time, experience has proved that it may difficult to transmit compressive or tensile forces from the surface of the well directly to a valve like that. This is due to the deviation of the well path from the vertical direction, and in particular of well paths in which the vertical deviation exceeds 60 degrees. This is a particularly great challenge in those cases in which the valve is operated by means of a cable or wireline.

The problems are due to, among other things, the fact that a substantial portion of the forces that are transmitted from the surface are spent on overcoming friction between the wireline and the well wall, for example. The problems increase with increasing distance between the well surface and the equipment to be operated.

In addition to the fact that it may be challenging to transmit sufficient forces for operating the well equipment, said frictional forces, among other things, will make it very difficult to determine exactly the amount of forces being supplied to the equipment. From the publication U.S. Pat. No. 2,399,766, a bridge plug that is operated by means of a setting tool is known. The setting tool is arranged to be connected to the plug and transfer rotational forces to it. To prevent the setting tool from rotating relative to the well in which the plug is located, the setting tool is provided with friction elements that project from the housing of the setting tool and engage with the well wall. The setting and pulling of the plug are carried out by rotation being imparted to the plug in one direction or the other. For such a set plug to be pulled out, the setting tool must first be pulled out of the well and up to the surface. At the surface, a clutch plate in the setting tool must be changed before the setting tool can be run into the well again in order then to be connected to the plug and then be activated to impart a rotational force to the plug so that this comes loose.

When a permanent plug is being set, U.S. Pat. No. 2,399,766 proposes the use of a shear mechanism to release the setting tool from the plug after this is set and fully installed.

From the publication US 2005/0056427 A1, a manipulation tool for connecting and controlling downhole equipment is known. The manipulation tool is provided with a gripping device for releasable engagement with the equipment. The tool is further provided with a driving device so as to produce an axial displacement or a rotation of a manipulation device.

From the publication US 2005/068775 A1, a manipulation tool for use in a well is known, the tool being provided with two motors with control units for activating locking pistons.

From the publications US 2011/0277986 A1, GB 2300441 A and US 2006/0090900 A1, other types of manipulation tools for use in a well are known.

In the international oil and gas industry there is great focus on reducing the operation time in connection with well maintenance, among other things. The industry has therefore, for a long time, clearly been expressing its need for new methods and new tools that can reduce the expenditure of time during well maintenance, and has, in that connection, been asking for a manipulation tool which is arranged to manipulate and monitor the well device, for example during the activation and deactivation thereof, all in one and the same operation.

Being able to use a well device repeatedly without the manipulation tool having to be pulled out of the pipe or well will result in great savings with respect to time and resource expenditure.

The industry has further expressed a need for a tool that does not have to be secured to the pipe wall, for example a well wall, before it is used to manipulate a well device. This is because wells that have been producing over time, especially an oil and gas well, may have been subjected to wear and corrosion. Therefore, after some years in the well, the real material strength of the pipe will be difficult to predict. Hence, there is a considerable risk of deforming the pipe if the remaining material strength in the pipe is overestimated as a tool is being secured to the wall of the pipe in connection with work being carried out.

The invention has for its object to remedy or reduce at least one of the drawbacks of the prior art or at least provide a useful alternative to the prior art.

The object is achieved through features which are specified in the description below and in the claims that follow.

In a first aspect of the present invention, a manipulation tool is provided for connection to and operation of a controllable well device, the manipulation tool comprising:

- an elongated housing with a first end portion and a second end portion;
- a gripping device arranged in the first end portion of the housing, the gripping device being configured to provide a releasable engagement with the well device that is to be controlled by means of the manipulation tool, the gripping device comprising means for resisting rotational and axial movement between the housing and the well device;

wherein the manipulation tool further comprising:

- at least one manipulation device arranged inside the housing, the manipulation device being axially displaceable between a first position and a second position along a longitudinal axis of the housing and rotatable around the longitudinal axis of the housing;
- a first driving device so as to produce axial displacement of the at least one manipulation device;
- a second driving device so as to produce rotation of the at least one manipulation device; and
- the first driving device and the second driving device are connected to a control unit which is arranged to control the energy supply to the driving devices.

A gripping device which is selectively releasable and which is arranged to resist rotational and axial movement between the housing and the well device has the effect of the manipulation tool not being able to rotate relative to the well device. Besides, the well device may repeatedly be connected to and disconnected from the manipulation tool without the manipulation tool having to be pulled out of the well. This makes the tool efficient and safe in use, which is particularly important in connection with operations offshore.

By positioning the driving devices in the tool itself, the loss of forces in consequence of, for example, friction between a well wall and the power-transmission means that extends between the surface of the well and the well device will be eliminated. An important effect of this is that the torque transmitted from the at least one manipulation device of the manipulation tool to the well device may be determined very precisely. This is particularly important when it is required that the well device be manipulated at a predetermined force or torque.

Controlling a well tool by means of rotation instead of by using axially movable components operated by compressive or tensile forces, explosives or nitrogen, has the effect of allowing the number of rotations that have been imparted to the well tool by the manipulation tool to be known at all times. This requires suitable measuring equipment, of course. Viewed isolatedly, such rotation-measuring equipment is available on the market.

The means of the gripping device of resisting rotational motion between the housing and the well device may be the same as the means of resisting axial movement between the housing and the well device. By such a solution, friction is used to provide hold against axial movement. The frictional force is provided by applying a torque to one of the at least one manipulation device, which means that axial movement between the housing and the well device may occur when the second driving device is inactive.

However, it may be an advantage if the means of the gripping device of resisting rotational motion between the housing and the well device are independent of the means of the gripping device of resisting axial movement between the housing and the well device. This has the effect of allowing the fastening means of the gripping device to be optimized, each for a respective purpose. The means of the gripping device of resisting considerable rotational forces may thereby be given a very robust design, whereas the means of the gripping device of resisting the axial forces may be formed slimmer and thereby be made more easily controllable. If the gripping means, to be able to resist the axial forces, are based on physical engagement and not exclusively friction as mentioned above, the engagement could be provided independently of whether the manipulation device is subjected to a torque or not. The axial engagement may thus become more reliable as the engagement is independent of energy supply to the manipulation device.

Such a reliable engagement can be provided by the means of the gripping device of resisting axial movement between the housing and the well device including a radially movable locking device which is arranged to be moved between a first position, in which the locking device is disengaged from a portion of the well device, and a second position, in which the locking device is in radially locking engagement with the well device. A solution like that will be well suited for use where, among other things, the well device is provided with a so-called fishing neck.

Movement between said first position and said second position may be provided by means of a third driving device which is arranged to influence the position of the locking device. For example, the third driving device may provide a push force which is transmitted to the locking device by means of a push rod.

As an alternative to said third driving device the position of the locking device may be determined by the position of one of the at least one manipulation device. This has the effect of allowing an operator to have feedback about the position of the gripping device based exclusively on the position of the manipulation device.

The locking device may be axially fixed to a portion of the housing, wherein the radial position of the locking device is controlled by a guide portion whose axial position is determined by the axial position of one of the at least one manipulation device.

In one embodiment, a portion of the housing includes an outer housing portion overlapping a portion of an inner housing portion, wherein a breakable fastening means is arranged in order to provide hold against axial movement between the housing portions. The inner housing portion may be axially connected to an end portion of the locking device, and the outer housing portion may be axially connected to the manipulation device, so that a breaking of the breakable fastening means will allow relative motion between the outer housing portion and the inner housing portion and thereby between the locking device and the guide portion as well. The breaking of the breakable fastening means is typically brought about by means of an external force, for example from a jar. After the breaking means has been broken, an external pull force may provide said relative motion between the locking device and the guide portion so that the manipulation tool may be pulled away from the well device.

Said second driving device may be connected to the at least one manipulation device via a power-transmission unit which is provided with a power-transmission means. In such a solution, the power-transmission means is complementarily adapted to a power-receiving portion arranged in the at least one manipulation device. The power-transmission portion and the power-receiving portion may typically be a toothed wheel arranged on a portion of the surface of the power-transmission means, the toothed wheel being in mesh with a toothed rim arranged on a portion of the external or internal surface of the manipulation device. By providing only a portion of said surfaces with said toothed wheel/toothed rim, the influence or power transmission of the driving device on/to the manipulation device may be made dependent on the axial position of the manipulation device relative to the housing. For example, the power-receiving portion may be arranged in such a way that it is in engagement with the power-transmission means only when the manipulation device is in one of the first position or the second position or in one or several other predetermined positions between said first position and second position.

In one embodiment, the power-transmission unit comprises a first portion and at least one second portion arranged in series in an axial direction of the power-transmission unit. At least one of the first portion and the second portion may be provided with a portion not transmitting power. Thus, the transmission of torque from the driving device to the manipulation device/each of the manipulation devices is determined by the axial position of the manipulation device in the housing. This will be explained further in the characterizing part of the application.

The manipulation tool may be provided with a gear which operatively connects the second driving device to the at least one manipulation device. This is for the purpose of reducing the rotational speed of the manipulation device and increasing its torque.

To be able to control the first and second driving devices, the manipulation tool is connected to a control unit which is arranged to control the energy supply to each of said driving devices. In one embodiment, the control unit is integrated in the housing of the manipulation tool. However, in an alternative embodiment, the control unit may be arranged at a distance from the housing of the manipulation tool. When the manipulation tool is used in connection with a tool in an offshore well, the control unit may be arranged, for example, on board a rig or anywhere between the housing and the rig.

The driving devices of the manipulation tool may both be electromotors or hydraulic motors, or one of the driving devices may be an electromotor while the other driving device is a hydraulic motor. In one embodiment, the first driving device which, in one embodiment, is to produce less power than the second driving device is an electromotor, whereas the second driving device is a hydraulic motor.

The driving device, whether an electromotor or a hydraulic motor, is of a kind known per se and will not be described any further in this document.

Energy for the driving devices may be provided from a source remotely located from the manipulation tool, for example on a rig, and is transmitted via a cable. Alternatively, the energy may be provided from a battery pack arranged in or in the vicinity of the manipulation tool. A combination of these is also conceivable, wherein the battery pack is primarily used as a back-up solution in case the remote energy source or a transmission cable should fail, and/or wherein the battery pack is used as an energy source for one of the driving devices when a combination of an electromotor and a hydraulic motor is used, and the other one of the driving devices is supplied with energy from said remote energy source.

The manipulation tool according to the first aspect is well suited for operating a well device, for example of the kind shown in the aforementioned NO 328302 and U.S. Pat. No. 8,333,219. However, a large proportion of existing well devices are arranged to be operated by means of an axial force. To be able to use the manipulation tool according to the invention also for a well device operated by axial force, there is a need for an adapter which is arranged to convert a torque from the manipulation device of the manipulation tool into an axial force.

According to a second aspect, an adapter is provided for use between the manipulation tool in accordance with the manipulation tool according to the first aspect of the present invention and a well device which is operated by means of an axial force, the adapter comprising:

- an elongated housing with a first end portion and a second end portion;
- a coupling means arranged to receive the gripping device of the manipulation tool, the coupling means being arranged in the first end portion of the housing;
- a shaft arranged in the first end portion of the housing, the shaft being arranged to receive torque from one of the at least one manipulation device of the manipulation tool, and the shaft being held fixed against axial movement along a longitudinal axis of the housing;
- a rod arranged to be movable in an axial direction in the second end portion of the housing, the rod being held fixed against rotation relative to the housing, and the rod being provided with a well-device coupling means for connection to a well device, the shaft being provided with a threaded portion which is arranged to be screwed together with a complementarily fitting threaded portion of the rod, so that a rotation of the shaft will lead to an axial movement of the rod.

In a third aspect of the present invention, a method of manipulating a controllable well device is provided, the method comprising the steps of:

bringing a manipulation tool according to the first aspect of the invention into contact with a well tool;

activating a first driving device in order to: bring a gripping device into releasable engagement with a coupling means arranged at an end portion of the well tool; and move at least one rotatable manipulation device axially into engagement with a portion of the well tool; and activating a second driving device by means of a control device in order to provide a desired rotation of one of the at least one manipulation device, the rotation being transmitted to a rotatable element in the well tool.

The well tool may be a well device selected from the group of: a valve; a plug; or a combination of these, wherein the well device is arranged to be operated by means of a torque applied thereto.

Alternatively, the well tool may be the adapter in accordance with the second aspect of the invention, so that it is the adapter that is connected to the well device. Such a connection is carried out in a manner known per se, by means of equipment known per se, and will not be described any further in this document.

The method may further, after the desired rotation of the manipulation device has been carried out, include activating the first driving device again in order to:

disengage the at least one rotatable manipulation device from the well device; and carry the manipulation tool away from the well tool.

Thus, the invention also relates to a method of manipulating a well device operable by axial force by the use of the manipulation tool according to the first aspect of the invention, the method comprising:

fitting an adapter according to the second aspect of the invention to the well device operable by axial force;

bringing the manipulation tool into contact with the adapter;

activating a first driving device in order to: releasably engage a gripping device of the manipulation tool with a coupling means arranged at an end portion of the adapter; and displace at least one rotatable manipulation device of the manipulation tool axially into engagement with a portion of the adapter; and activating a second driving device by means of a control device in order to provide a desired rotation of one of the at least one manipulation device, the rotation being transmitted to a rotatable element in the adapter.

The well device operated by axial force may for example be selected from the group of: a valve, a plug, a straddle packer, or a combination of these.

After the desired rotation of the manipulation device has been carried out, the method may further comprise activating the first driving device again in order to:

disengage the at least one rotatable manipulation device from the adapter; and carry the manipulation tool away from the adapter.

As an alternative to carrying the manipulation tool away from the adapter, the method may, after the desired rotation of the manipulation device has been carried out, comprise:

continuing the rotation of the manipulation device so that a further axial force is transmitted from the adapter to the well device until the engagement between the adapter and the well device is disintegrated; and carrying the manipulation tool and the adapter away from the well device.

Said alternative method may be particularly relevant for the operation of a well device operated by axial force such as a so-called permanent plug or some other permanent well device which there will be no need to operate at a later time.

I what follows, an example of a preferred embodiment is described, which is visualized in the accompanying drawings in which:

FIG. 1*a* shows in perspective a partially cutaway view of a manipulation tool according to the present invention, the manipulation tool including a first manipulation device which is coaxially arranged on the outside of a second manipulation device, and the manipulation devices being placed in a retracted position;

FIG. 1*b* shows a first end portion of the manipulation tool of FIG. 1 on a larger scale;

FIG. 1*c* shows the detail 1C of FIG. 1*a* on a larger scale;

FIG. 2*a* shows the manipulation tool of FIG. 1*a*, but an axial displacement of the manipulation devices from the right to the left has been carried out;

FIG. 2*b* shows the first end portion of the manipulation tool of FIG. 2*a* on a larger scale;

FIG. 2*c* shows a detail 2C of FIG. 2*a* on a larger scale;

FIG. 3*a* shows the manipulation tool of FIG. 2*a*, but the first manipulation device has been axially displaced to an advanced position, whereas the second manipulation device is in a partially advanced position;

FIG. 3*b* shows the first end portion of the manipulation tool of FIG. 3*a* on a larger scale;

FIG. 4*a* shows the manipulation tool of FIG. 3*a*, but the second manipulation device, too, has been displaced to its advanced position;

FIG. 4*b* shows the first end portion of the manipulation tool of FIG. 4*a* on a larger scale;

FIG. 5 shows the manipulation tool of FIG. 4*a*, but the tool is in a releasing situation;

FIG. 6*a* shows the manipulation tool of FIG. 5, but the first manipulation device is in a retracted position, and the second manipulation device is in a partially retracted position;

FIG. 6*b* shows the first end portion of the manipulation tool of FIG. 6*a* on a larger scale;

Figure 10A:
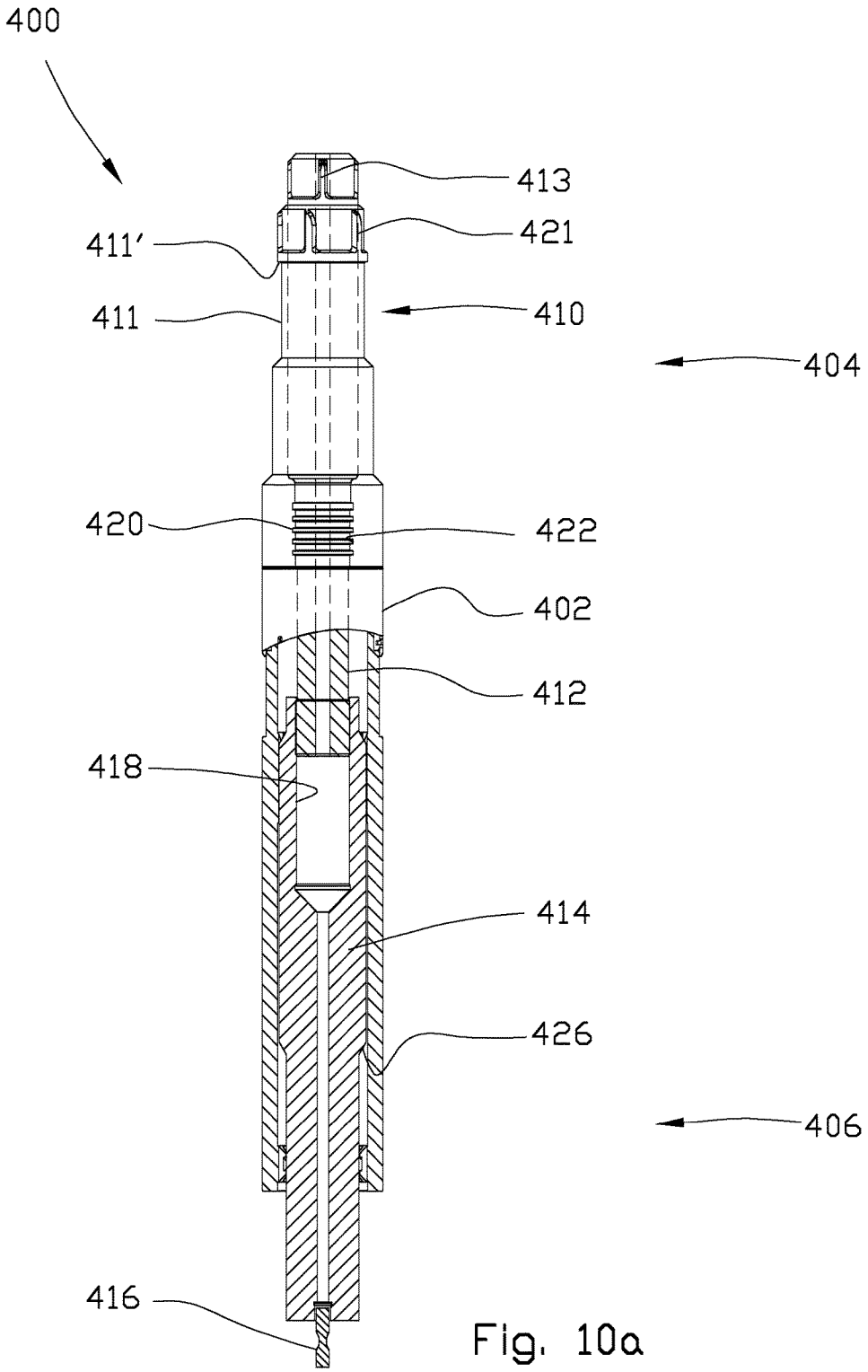
Figure 10B:
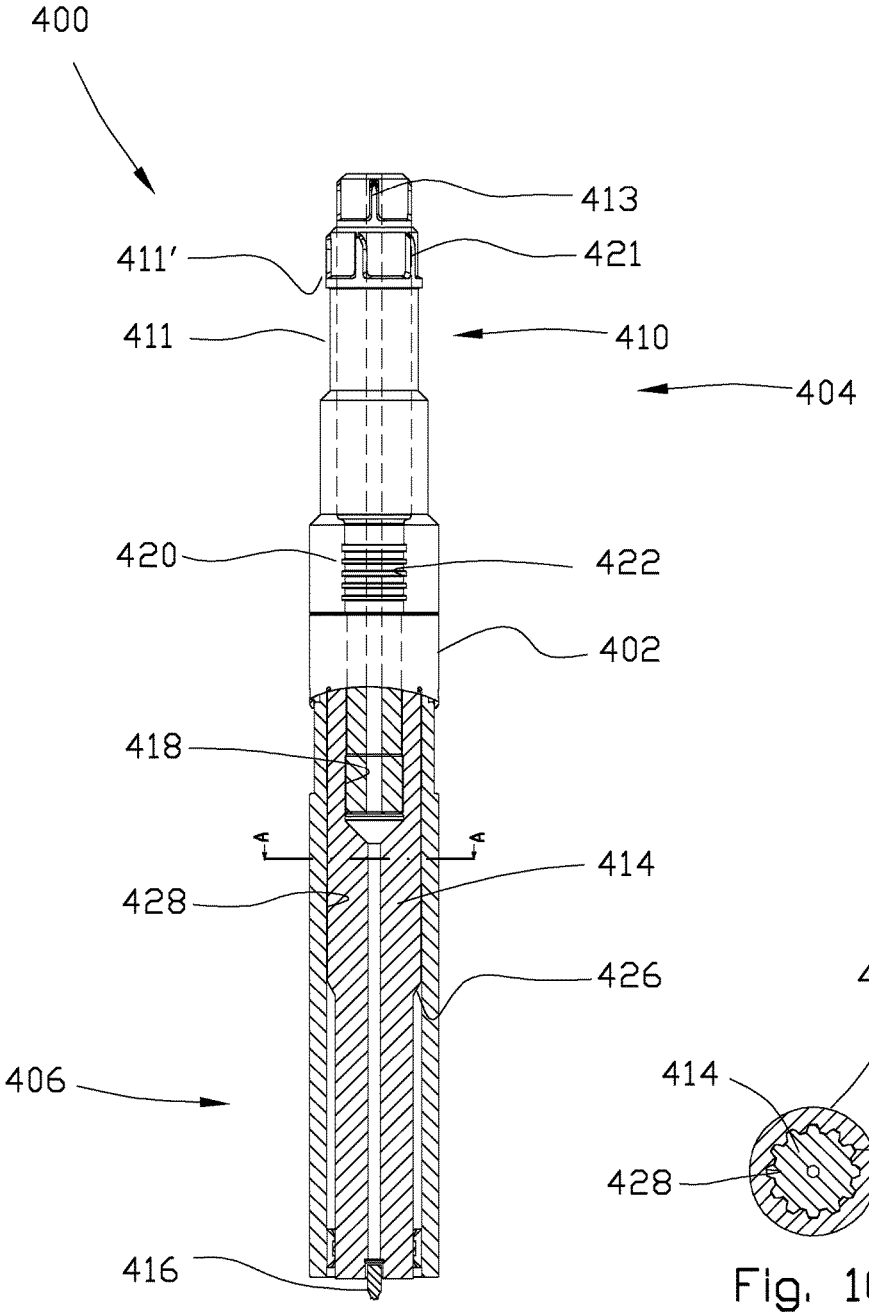
Figure 10C:
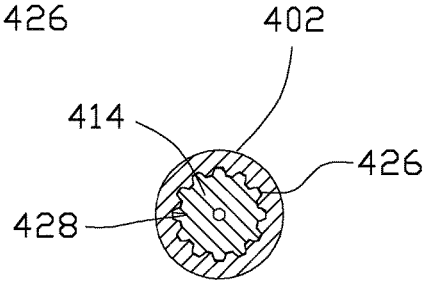

FIGS. 10*a* and 10*b* show an adapter arranged to be placed between the manipulation tool and the well device; and FIG. 10*c* shows a cross section seen through the line A-A in FIG. 10*b*.

Positional specifications such as "outer", "inner", "left", "right", "upper" and "lower" allude to the position that is shown in the figures. Like or corresponding parts are indicated by the same reference numeral in the figures, but because of the richness in detail, not all parts are indicated with reference numerals in all the figures.

In the figures, the reference numeral 1 indicates a manipulation tool according to the present invention.

The manipulation tool 1 includes an elongated housing 3 with a first end portion 5 and a second end portion 7.

A gripping device 10 is arranged in the first end portion 5 of the housing 3. The gripping device 10 includes holding lugs 12 (two shown) projecting from the internal surface of the gripping device 10. The holding lugs 12 are arranged to be brought into sideways abutment against corresponding lugs 121 arranged on a well device 120 (see FIG. 9) which is to be manipulated, so that at least a relative rotation between the well device 120 and the manipulation tool 1 is prevented.

The gripping device 10 is further provided with locking fingers 14, so-called "latches" which are arranged to be driven radially inwards to engage, for example, a fishing neck 123 (see FIG. 9) of the well device 120 and thereby prevent axial displacement between the manipulation tool 1 and the well device 120. How the radial positions of the latches 14 are controlled will be explained in further detail in what follows.

In the embodiment shown, the manipulation tool 1 is provided with a first manipulation device 20 which is coaxially arranged on the outside of a second manipulation device 30. In what follows, the first manipulation device will also be referred to as the main manipulator 20, and the second manipulation device 30 as the operational manipulator 30.

Both the main manipulator 20 and the operational manipulator 30 are arranged axially displaceable along and rotatable around a centre axis of the housing 3.

The main manipulator 20 is provided with engagement means 22 which, in the embodiment shown, are of the same kind as the holding lugs of the gripping device 10. The engagement means 22 are arranged to engage with, which, in the embodiment shown, means to be brought to rest against, corresponding holding lugs 122 arranged on the well tool 120 (see FIG. 9).

Figure 9:
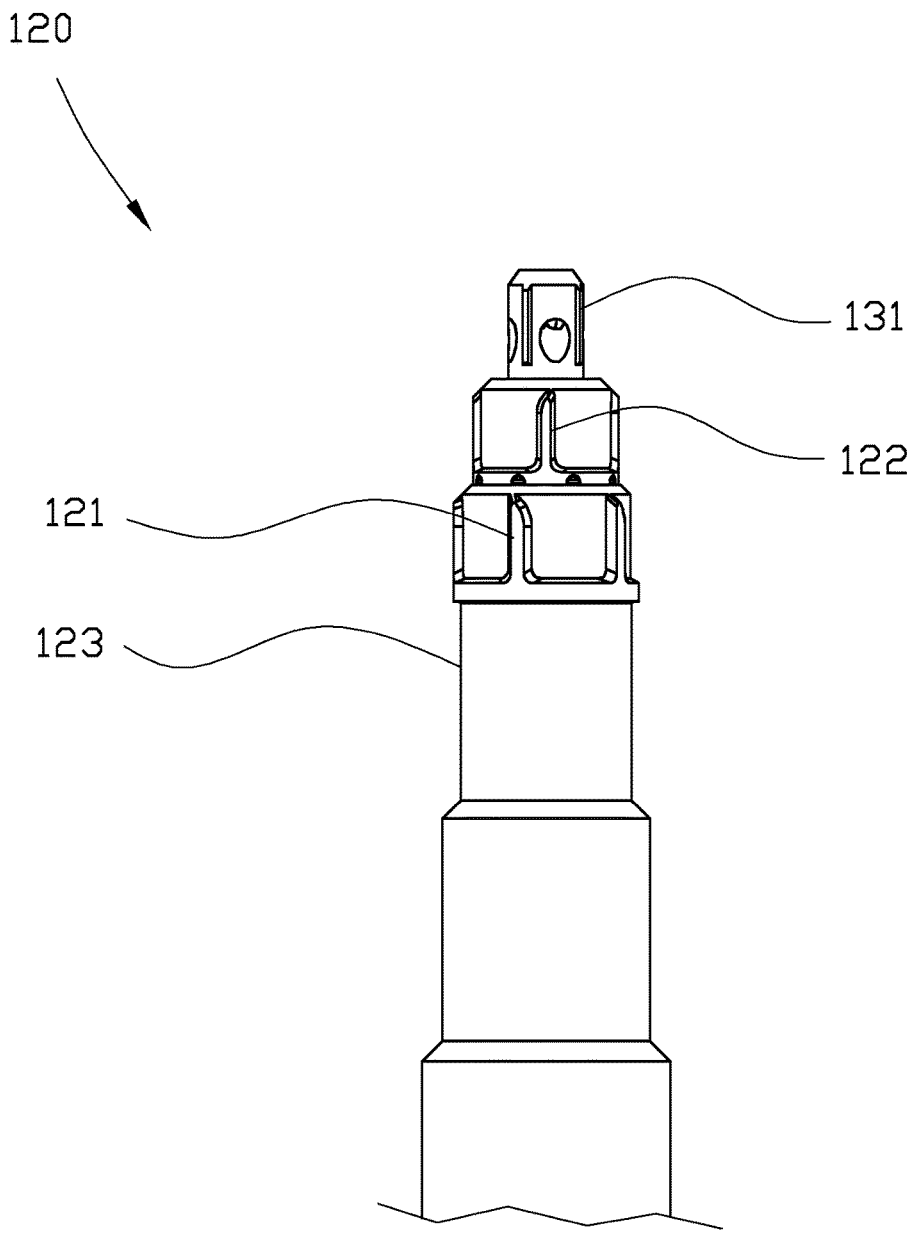
FIG. 9 shows a connecting portion of a well tool, with which the manipulation tool is arranged to engage.

Correspondingly, the operational manipulator 30 is provided with engagement means 31 which are arranged to engage with corresponding holding lugs 131 arranged on the well tool 120 (see FIG. 9).

It should be noted that the holding lugs 22 and said corresponding lugs 122 on the well device 120 could also be used to provide so large a frictional force between the holding lugs 22 and 122 that the frictional force locks against axial displacement (separation) between the manipulation tool 1 and the well device 120. In one embodiment (not shown), the holding lugs 22 are provided with a means of increasing the friction between the holding lugs 22 and the holding lugs 122 of the well device 120. Such a means may be, for example, a serrated surface or other non-smooth surfaces or shapes. Such solutions may be dependent on a torque having been applied to a manipulation device. To ensure the integrity even without such a torque, a so-called "J-slot" may be used, which may be compared with a hook-and-barb solution that will keep even if the torque should decrease.

Axial displacement of the manipulation devices 20, 30 along the centre axis of the housing 3 is provided by means of a first driving device 40. The first driving device 40 is connected to a rod 42 which is provided with an externally threaded portion 46. A portion of the rod 42 is axially displaceable inside a holding sleeve 44 by means of a toothed wheel 45. The holding sleeve 44 is fixedly positioned inside the housing 3. The toothed wheel 45 is further provided with internal threads that complementarily fit the threads of the rod 42. When the toothed wheel 45 is set into rotation by means of the first driving device 40, the threads will bring the rod 42 to be moved in an axial direction relative to the holding sleeve 44. In what follows, the first driving device 40 will also be referred to as a gear motor 40. By means of splines 47, the rod 42 is prevented from rotating.

An end portion of the rod 42 has been passed through an opening in a holding element 32 associated with the operational manipulator 30. In the exemplary embodiment shown, said opening is arranged in a centre portion of the holding element 32 so that the rod 42 is coaxial with the operational manipulator 30. The rod 42 is attached to the holding element 32 by means of a fastening device 46 which prevents axial movement between the rod 42 and the holding element 32, but allows rotation between them. Thus, rotation of the toothed wheel 45 will provide axial displacement of the operational manipulator 30 relative to the housing 3 in one direction or the other, depending on the direction of rotation of the toothed wheel 45.

By providing the gear motor 40 with a rotation-measuring device, a so-called resolver, which, viewed isolatedly, is of a kind known per se, the axial position of the operational manipulator 30 and thereby also of the main manipulator 20 in the manipulation tool 1 will be known at all times. The resolver is typically connected to a control system 80 which, in the embodiment shown, is indicated in broken lines.

Figure 1A:
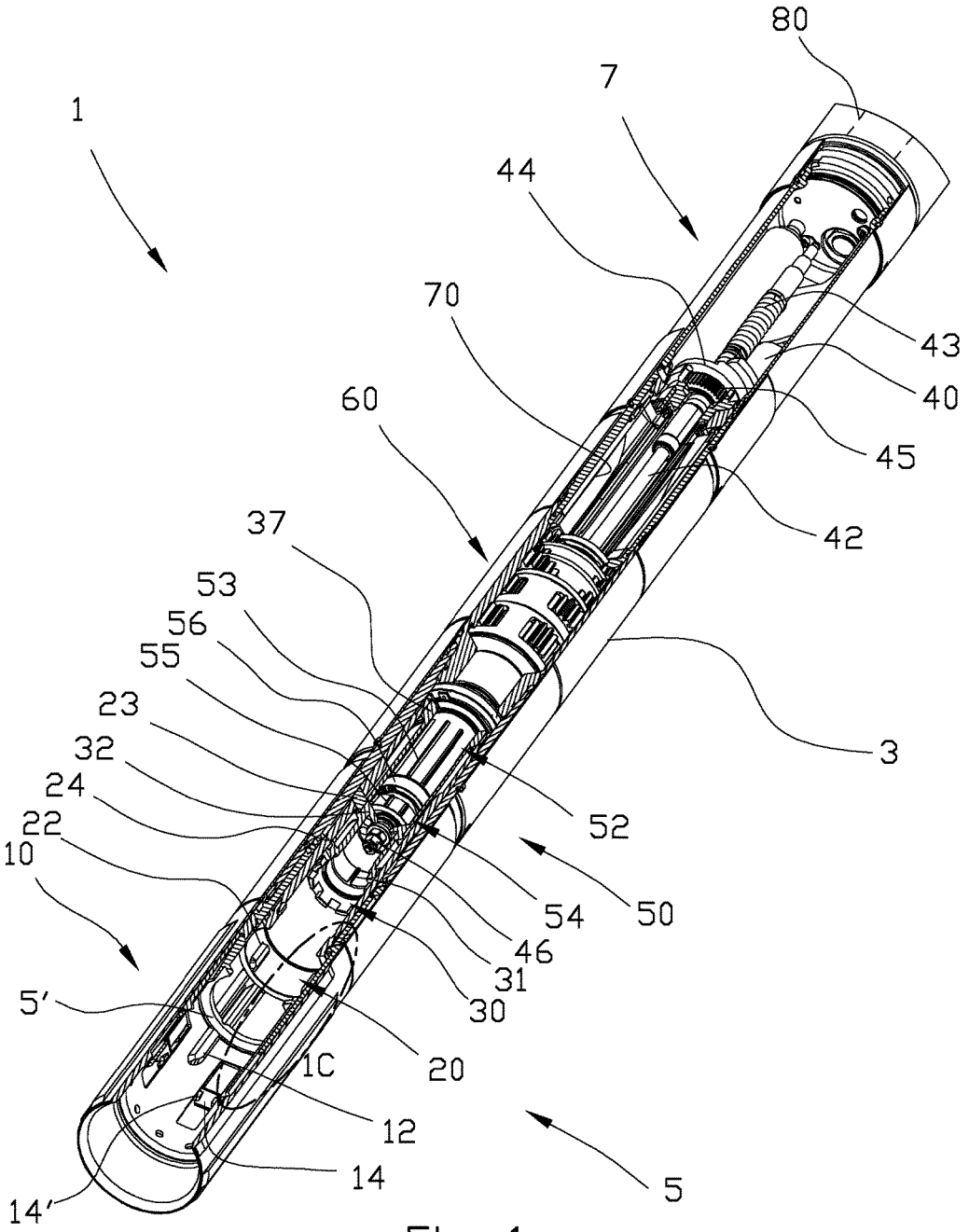
Figure 3A:
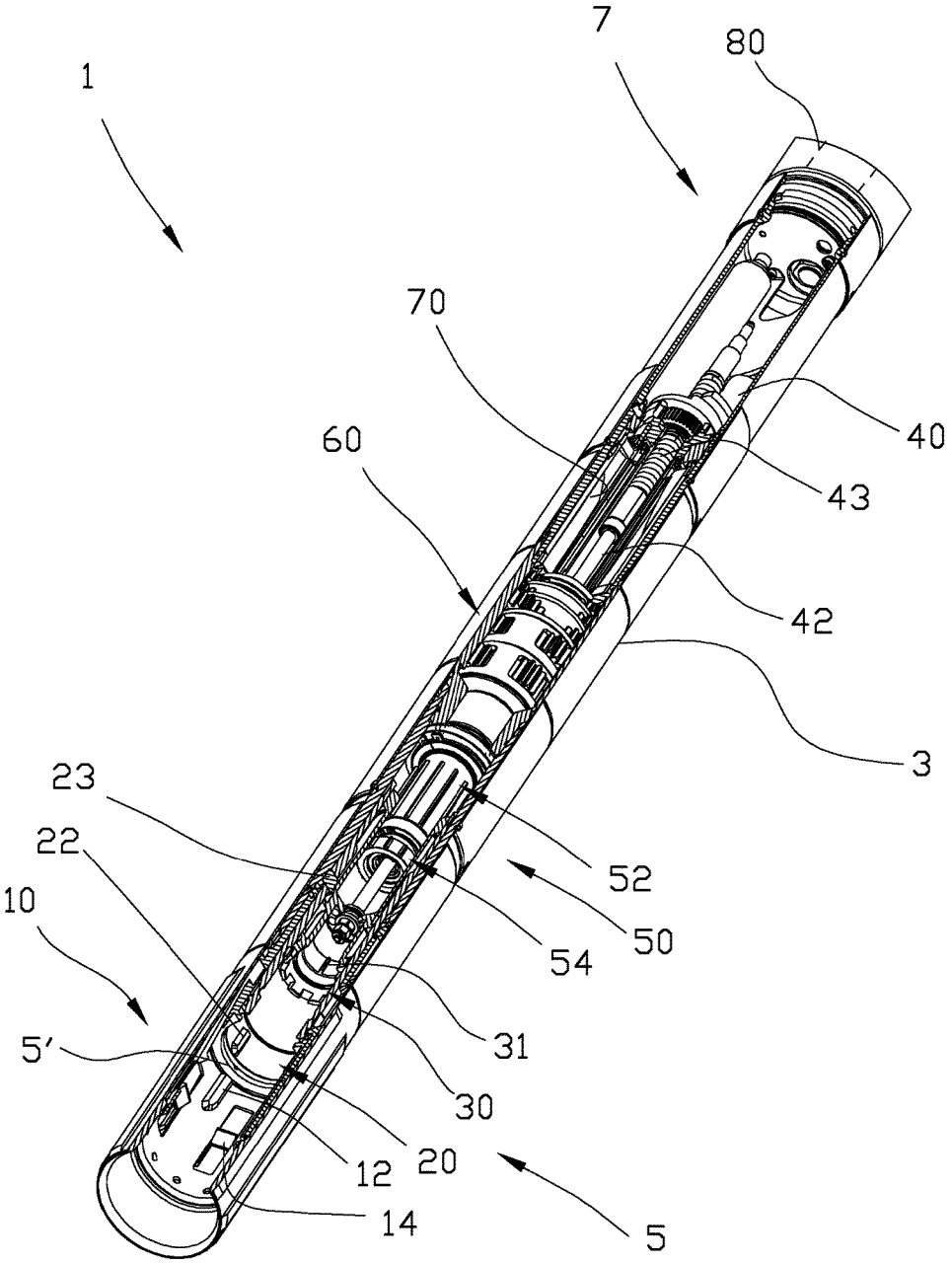
Figure 3B:
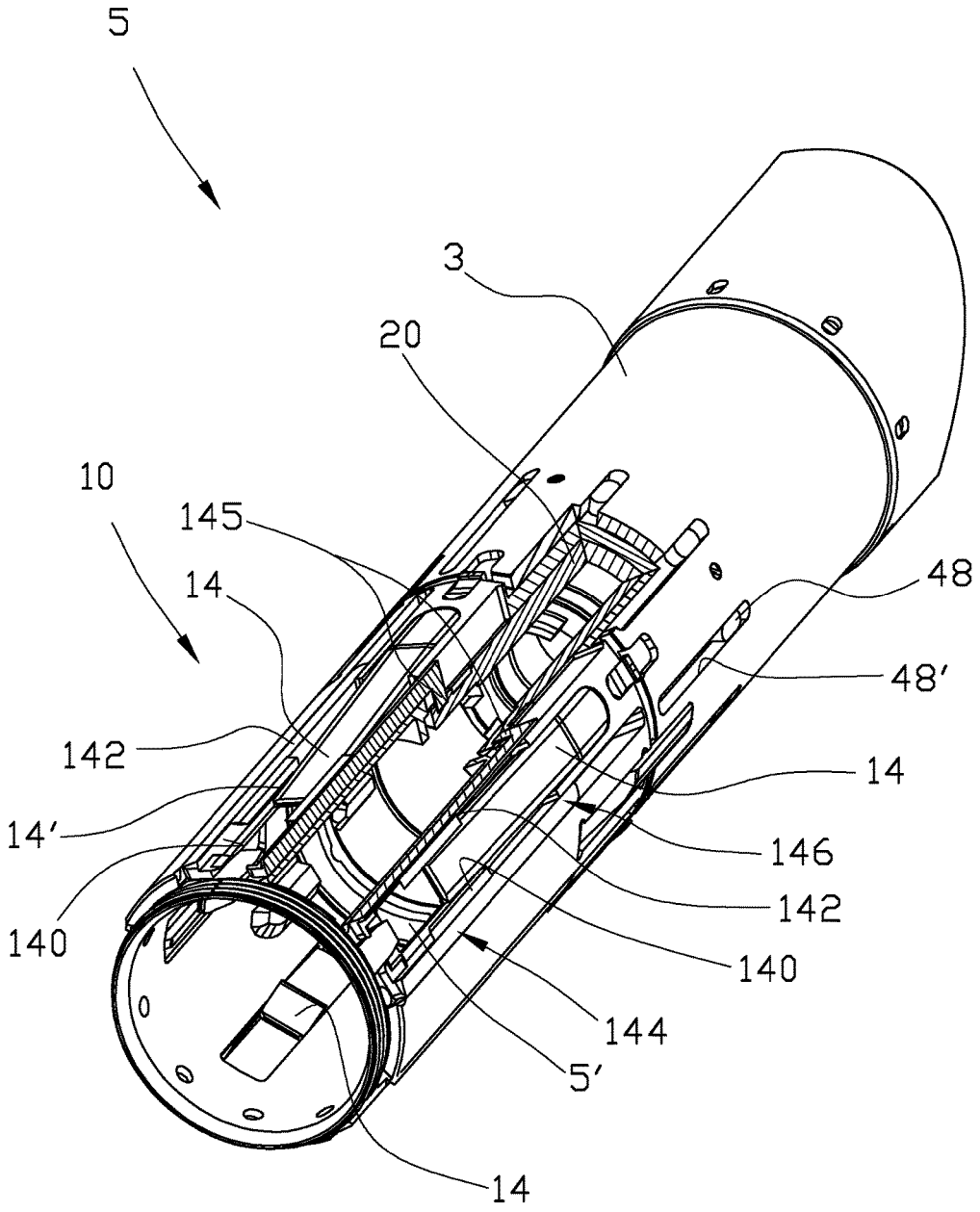
Figure 4A:
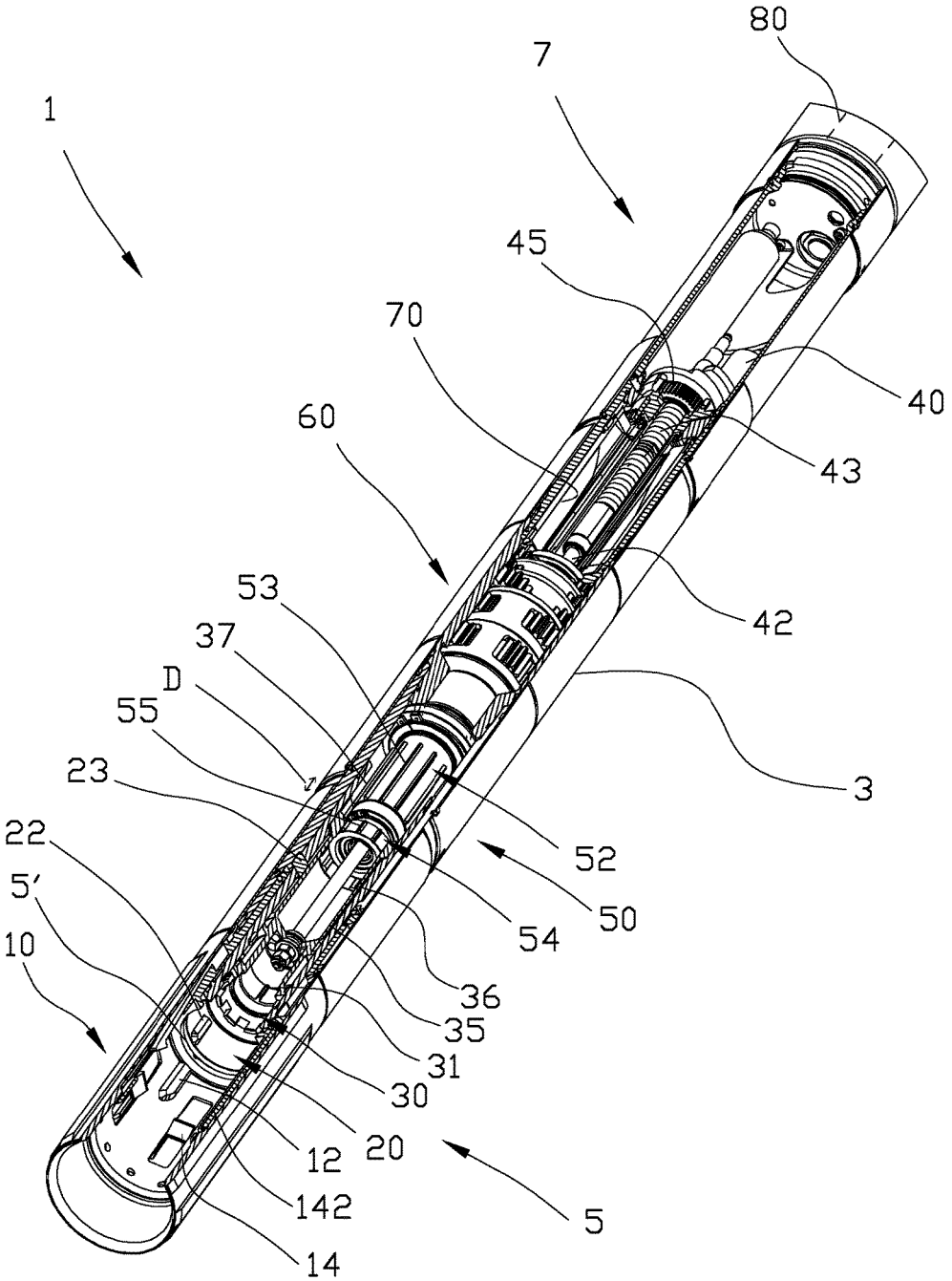

In the embodiment shown, in which the manipulation tool 1 is provided with two manipulation devices 20, 30, axial movement of the main manipulator 20 between the retracted position shown in FIG. 1*a* and the advanced position shown in FIGS. 3*a* and 4*a* is controlled by means of the operational manipulator 30 and a plurality of carrier blocks 23 (one shown) which are arranged in respective recesses in the wall of the main manipulator 20.

The carrier blocks 23 are arranged to be radially movable between a first, projecting position and a second, retracted position.

Figure 2A:
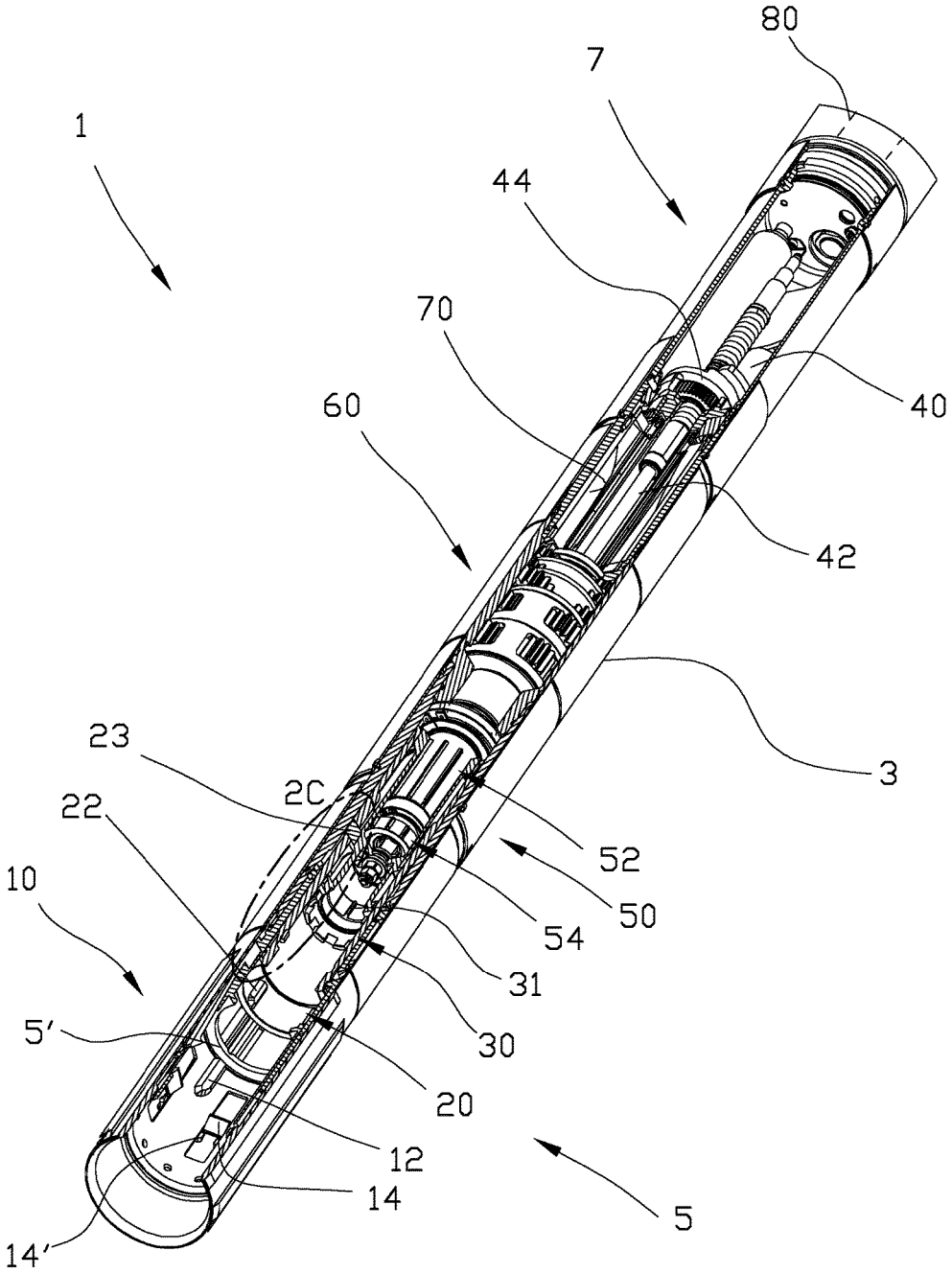
Figure 2B:
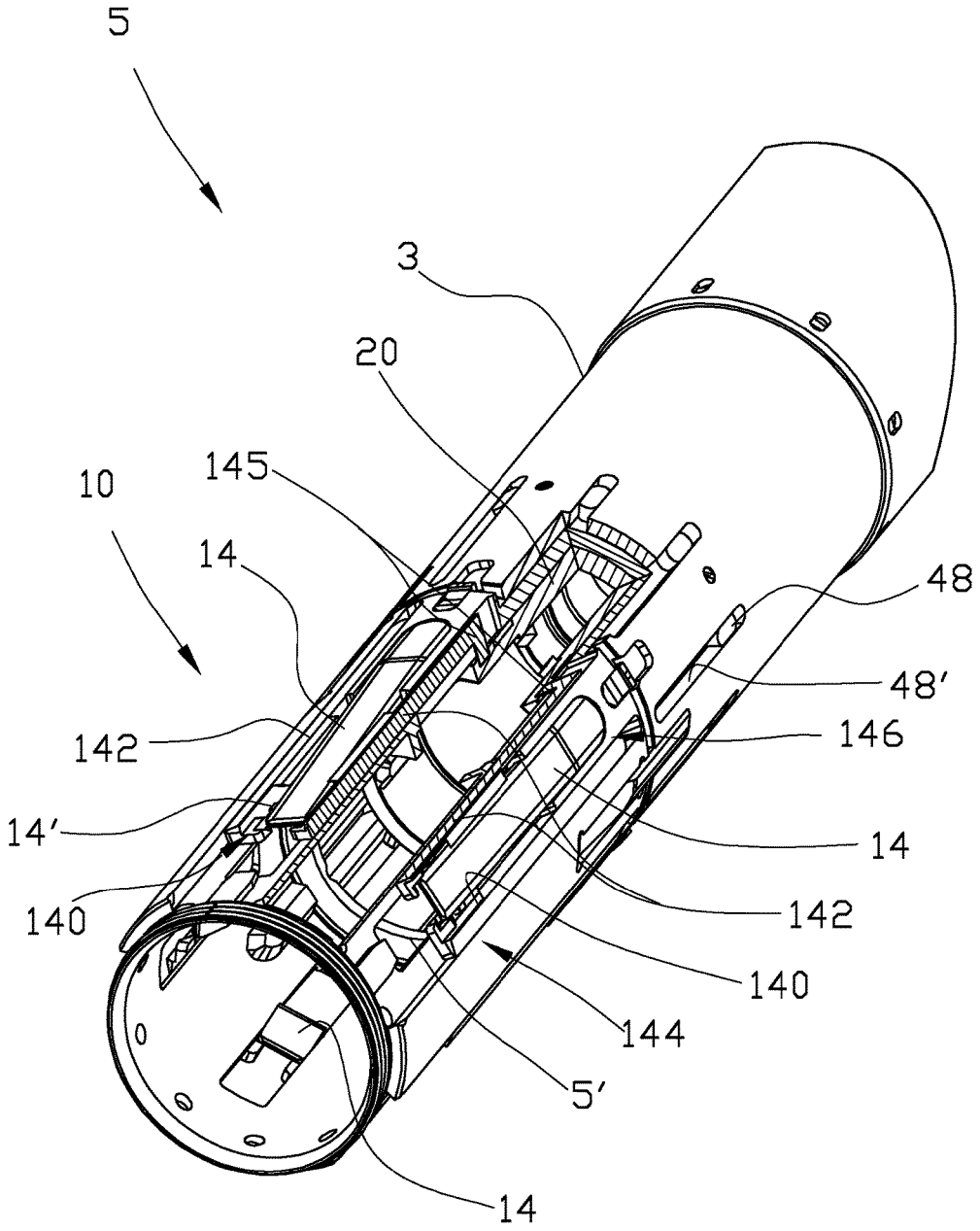
Figure 2C:
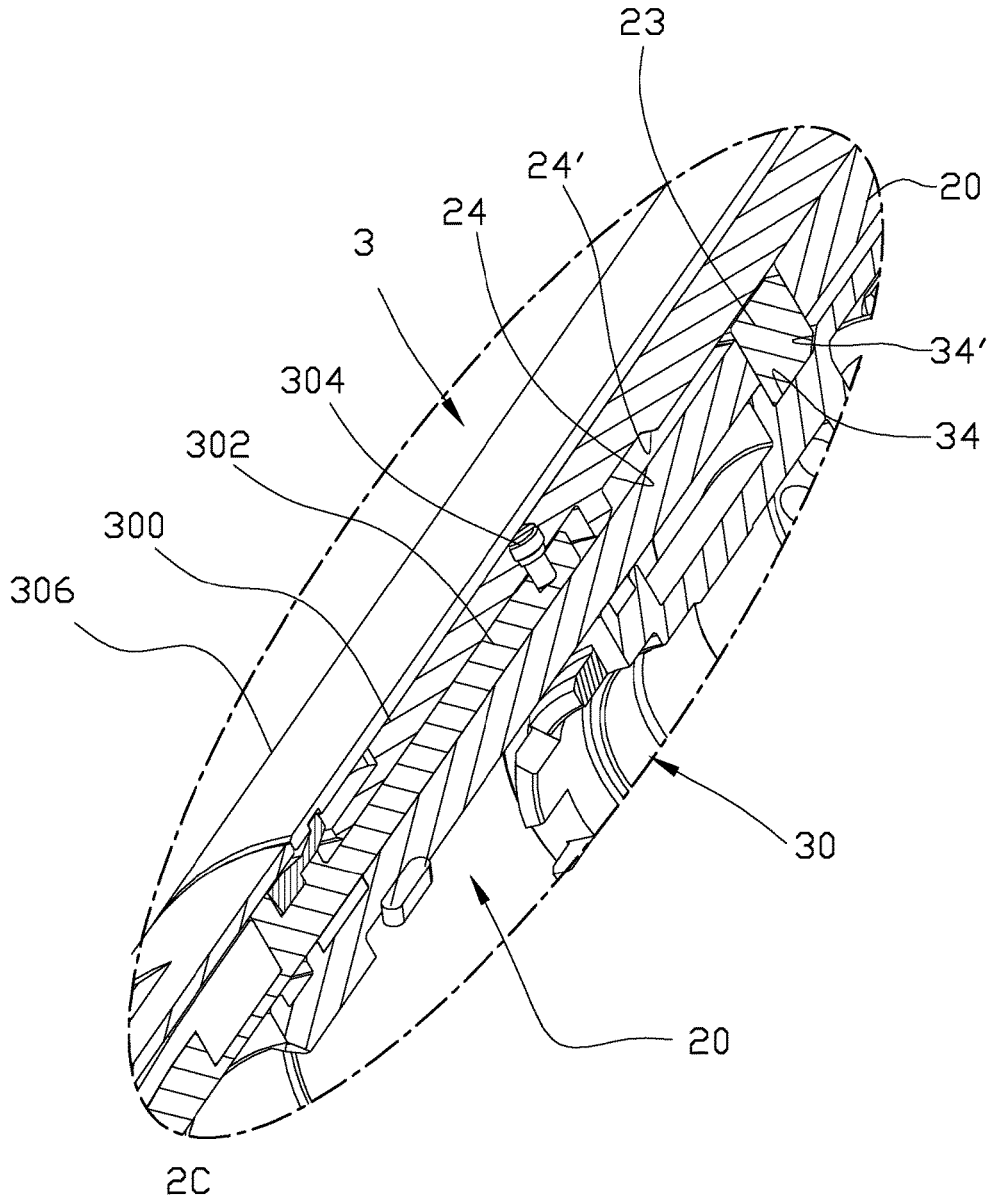

In the first, projecting position, the carrier blocks 23 are in engagement with a carrier-block groove 34 formed in a portion of the external surface of the operational manipulator 30, as shown in FIG. 1*a* and FIG. 2*a* and as seen best in FIG. 2*c*.

Figure 5:
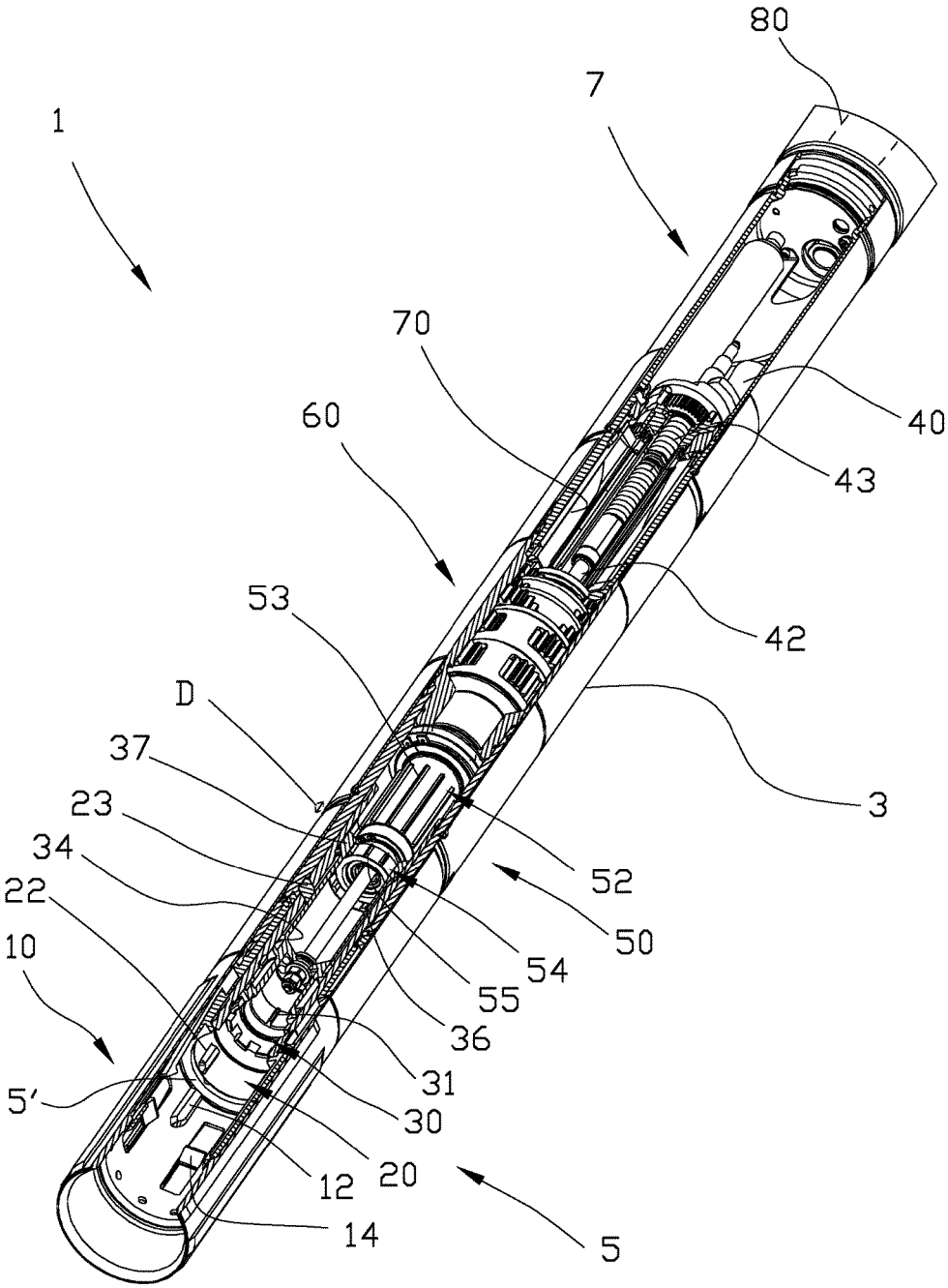

In the second, retracted position, the carrier blocks 23 have been driven out of the carrier-block groove 34 and into a carrier-block-receiving groove 24 arranged in portions of the internal surface of the housing 3. In this retracted position, the carrier blocks 23 rest against the external surface of the operational manipulator 30, as shown in FIGS. 3*a*, 4*a* and 5 among others.

The carrier blocks 23 are driven out of the carrier-block groove 34 by means of an inclined plane 34' arranged in the carrier-block groove 34 (see FIG. 2*c*) so that the carrier blocks 23 are moved along the inclined plane 34' when there is an axial movement between the operational manipulator 30 and the main manipulator 20. Correspondingly, the carrier-block-receiving groove 24 is provided with an inclined plane 24' which is seen best in FIG. 2*c*.

Radial movement of the carrier blocks 23 between said two positions is provided by axial movement of the operational manipulator 30 from a position in which said grooves 24, 34 are in the same axial position in the manipulation tool 1 to a position in which said grooves are axially offset relative to each other.

Rotation of one or both of the main manipulator 20 and the operational manipulator 30 around the longitudinal axis of the manipulation tool 1 is provided by means of a power-transmission unit 50.

The power-transmission unit 50 is connected via a gear 60 to a second driving device 70. In what follows, said second driving device 70 will also be referred to as the main motor 70. In the embodiment shown, the main motor 70 is an electromotor of a kind known per se, but it will be understood that in an alternative embodiment, the main motor may be a fluid-driven motor such as a hydraulic motor or a pneumatic motor of a kind known per se.

The gear 60 is necessary only if the torque required for the operation of the well device 120 exceeds the torque that can be provided directly from the main motor 70.

However, a person skilled in the art will know that the torque that will be required in many cases in order to operate a well device will require a very powerful and thereby bulky main motor. To be able to make a slimmest possible manipulation tool 1, it will therefore, for many areas of application, be advantageous for the torque that is provided by the main motor 70 to be increased by means of the gear 60 before being transmitted to the power-transmission unit 50.

In the embodiment shown, the torque amplifier or gear 60 consists of a five-stage planetary gear, but it will be understood that more or fewer than the five stages shown may be used. The exemplary embodiment shown in the figures reflects a well-functioning prototype of the present invention in which a planetary gear 60 that provides an increase of approximately a thousand times the torque from the main motor 70 is used.

In the embodiment shown, the power-transmission unit 50 is shown as a two-part one, comprising a first power-transmission portion 52 with a first power-transmission means in the form of a first toothed rim 53 and a second power-transmission portion 54 with a second power-transmission means in the form of a second toothed rim 55.

The first power-transmission portion 52 is arranged coaxially with, but at an axial distance from, the second power-transmission portion 54. The power-transmission portions 52, 54 are each connected to a respective one of the five stages shown. This means that the first power-transmission portion 52 and the second power-transmission portion 54 are rotating together, but at different rotational speeds. The second power-transmission portion 54 may, for example, rotate ten times faster than the first power-transmission portion 52.

The operational manipulator 30 includes a drive sleeve 35 (see FIG. 7) which is coaxial with the power-transmission unit 50 and axially displaceable relative thereto. An end portion of the drive sleeve 35 is provided with a power-receiving portion in the form of an internal toothed rim 36 which complementarily fits said first toothed rim 53 and said second toothed rim 55. The internal toothed rim 36 of the drive sleeve 35 is shown in FIGS. 4*a* and 5 among others.

At its end portion, the drive sleeve 35 is further provided with a power-transmission means in the form of an external toothed rim 37 which will be referred to, in what follows, as the main-manipulator drive rim 37.

The main-manipulator drive rim 37 is complementarily adapted to a power-receiving portion in the form of a toothed rim arranged in an internal end portion of the main manipulator 20. The toothed rim 27 will be referred to, in what follows, as the receiving rim 27. The receiving rim 27 is shown best in FIG. 7.

With reference to the FIGS. 1*a*-5, the operation of the manipulation tool 1 will be explained more thoroughly. Even if the FIGS. 1*a*-5 show the operation in "steps", it will be understood that the operation from the position of the tool in FIG. 1*a* to the position of the tool in FIG. 5 may be a continuous one.

In FIG. 1*a*, the manipulation tool 1 is shown in an initial position. In the initial position shown, both the main manipulator 20 and the operational manipulator 30 are in a retracted position in which the manipulators 20, 30 are at the greatest possible distance from the first end portion 5 of the manipulation tool 1. In this position, both the gear motor 40 and the main motor 70 will normally be turned off.

When the main manipulator 20 is in this position, the latches 14 of the gripping device 10 will be in a radially retracted position relative to an internal surface of the first end portion 5 of the manipulation tool 1. This appears from FIG. 1*b*.

FIG. 2*a* shows the manipulation tool 1 after the toothed wheel 45 has been set in rotation by the gear motor 40 and has brought about a short-distance axial displacement of both the operational manipulator 30 and the main manipulator 20 from the initial position shown in FIG. 1*a* towards the first end portion 5 of the manipulation tool 1. The simultaneous displacement of both manipulators 20, 30 happens in consequence of the carrier blocks 23 being in engagement with the carrier-block groove 34 formed in the external surface of the operational manipulator 30 as explained earlier.

As a consequence of the axial movement of the main manipulator 20, the latches 14 will be driven a distance radially inwards towards the centre axis of the manipulation tool 1. Such a radial movement by the latches 14 is provided by lugs 14' protruding from the latches 14 being moved in a guideway 140 defined between paired guiding elements 142 which are defined, in their longitudinal direction, by a first end portion 144 and a second end portion 146, see FIGS. 1*b* and 7. The guideway 140 exhibits a guide track starting at the first end portion 144 and extending a distance towards the second end portion 146 before the guide track has its end point. The radial distance of the guideway 140 from the centre axis of the manipulation tool 1 is larger at the starting point of the guide track than at the end point of the guide track.

Figure 1B:
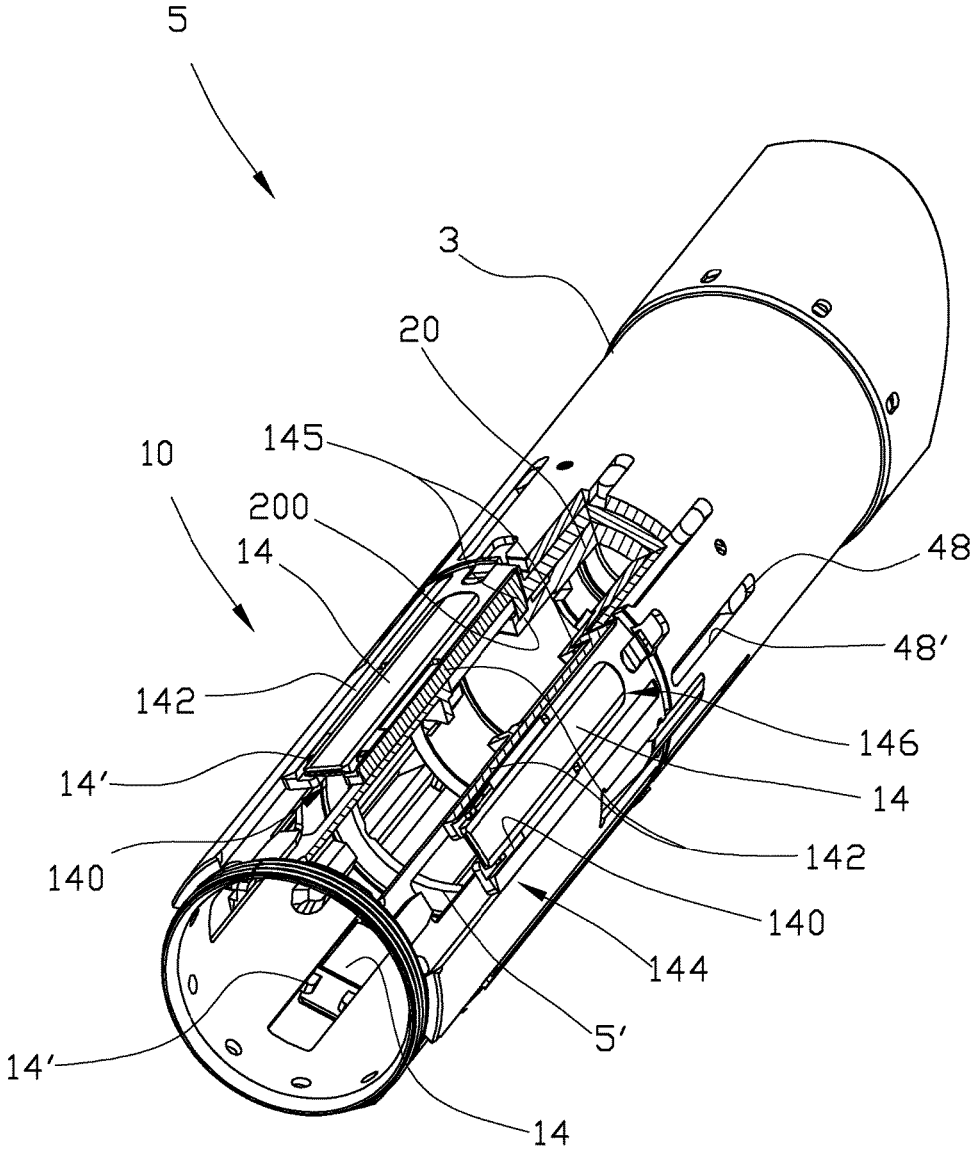
Figure 1C:
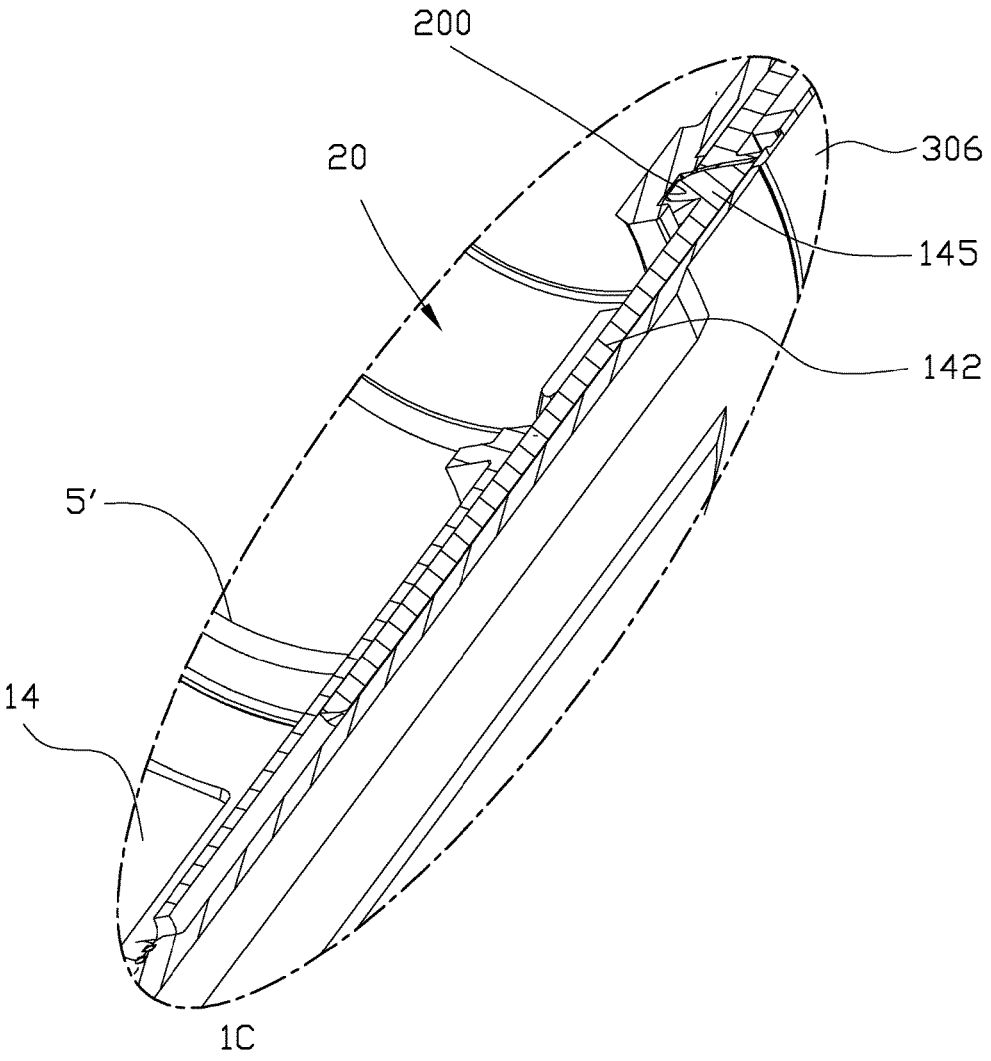

As appears from FIG. 1*b*, each of the guiding elements 142 in the second end portion 146 is provided with a guiding-element lug 145 extending into a groove 200 arranged in an end portion of the external surface of the main manipulator 20. The groove 200 allows the main manipulator 20 to be rotated relative to the guiding elements 142, but prevents the main manipulator from being movable, beyond play, if any, in an axial direction relative to the guiding elements 142.

When the main manipulator 20 is set in axial motion from the position that is shown in FIG. 1*a* to the position that is shown, for example, in FIG. 2*a*, the guiding-element lugs 145 and thereby the guiding elements 142, too, will be subjected to an axial movement corresponding to that of the main manipulator 20. The latches 14 are fixed against axial movement relative to the housing of the manipulation tool 1. An axial movement of the main manipulator 20 will thereby result in relative motion between the guideway 140 and the latches 14. The latches 14 will thus be brought from their retracted position as shown in FIG. 1*b* to their projecting position as shown, for example, in FIG. 2*b*.

Figure 4B:
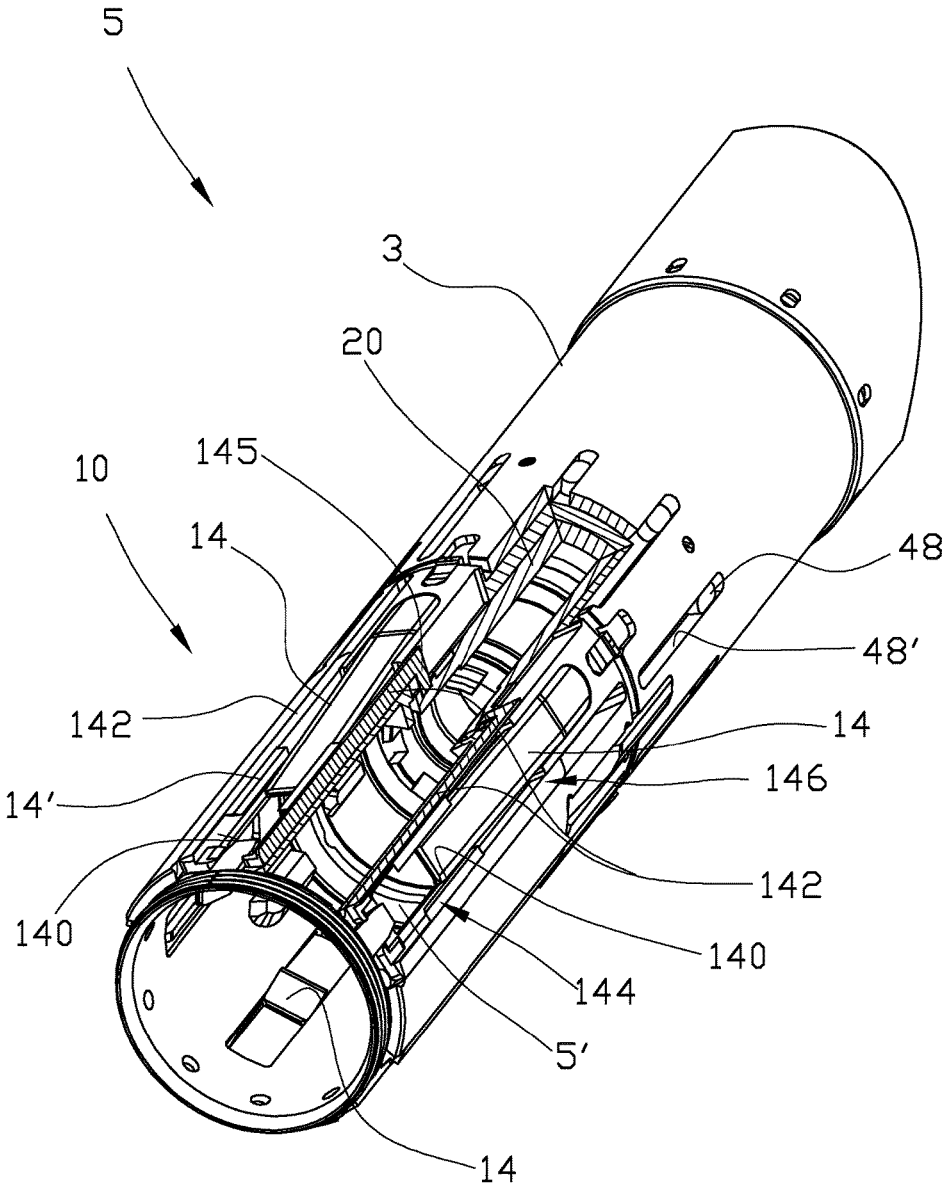

When the main manipulator 20 is in the advanced position as shown in FIGS. 3*a*, 4*a* and 5, the lugs 14' of the latches 14, and thereby the latches 14, too, will be prevented from radial movement because of the radial extent of the guideway 140 in this portion substantially being complementarily adapted to the radial extent of the lugs 14', as indicated in FIG. 4*b*.

Reference is now made to FIG. 3*a* which illustrates a situation in which the main manipulator 20 has been moved towards, but does not touch, a shoulder 5' projecting radially from an internal surface of the first end portion 5 of the housing 3. The main manipulator 20 is thus in an advanced position.

In the advanced position shown in FIG. 3*a*, the main manipulator 20 may be set into rotation by supplying energy to the main motor 70 which will then set the power-transmission unit 50 into rotation. With the help of a control unit 80, the rotation may be clockwise or anticlockwise. In the embodiment shown, the control unit 80 is placed in the second end portion 7 of the manipulation tool 1, as indicated in broken lines. It will be understood that, in an alternative embodiment, the control unit 80 may be placed at a distance from the manipulation tool 1 itself, for example aboard a rig or somewhere between the manipulation tool 1 and said rig. However, it should be added that it is an advantage if the control unit 80 is placed in or in direct proximity to the manipulation tool 1 because there will be no need for a special cable then. A person skilled in the art will know that such a special cable will be exposed to the well environment and to stresses such as impacts, squeezing and tensile stresses which may all result in damage to the cable and thus hamper or destroy the controllabilities of the manipulation tool 1.

In FIG. 3*a* the torque is transmitted to the main manipulator 20 from the first toothed rim 53 in the first portion 52 of the power-transmission unit 50, via the main-manipulator drive rim 37 to the receiving rim 27 (see FIG. 7) which is arranged in the internal portion of the main manipulator 20. By the very fact of the rotation being transmitted via the main-manipulator drive rim 27 forming part of the operational manipulator 30, the operational manipulator 30, too, will rotate.

The manipulation tool 1 according to the embodiment shown is well suited for use together with the plug that is shown in the publications NO 328302 and U.S. Pat. No. 8,333,219, where the main manipulator 20 is used to activate the slips and packer of the plug, whereas the operational manipulator 30 is used to control the opening and closing of the valve of the plug.

To bring the operational manipulator 30 from the position shown in FIG. 3*a* to the advanced position as shown in FIG. 4*a*, the interconnection between the operational manipulator 30 and the main manipulator 20 must be broken, by the very fact of the main manipulator 20 already having been placed in its advanced position. In other words, the carrier blocks 23 must be disengaged from the operational manipulator 30, which is achieved by rotating the toothed wheel 45 further by means of the gear motor 40.

The manipulation tool 1 is formed in such a way that when the main manipulator 30 is in its advanced position, the carrier blocks 23 will be in the same axial position as the carrier-block-receiving groove 24.

Because of the inclined plane 34' arranged in the carrier-block groove 34 of the operational manipulator 30, the carrier blocks 23 will, on continued axial movement of the operational manipulator 30 in the direction of the first end portion 5 of the manipulation tool 1, be driven out of the carrier-block groove 34 and into the carrier-block-receiving groove 24, as explained above. The engagement of the carrier blocks 23 with the operational manipulator 30 will thus cease, and the operational manipulator 30 can be moved on towards said first end portion 5 until the operational manipulator 30 is in its advanced position as shown in FIG. 4*a*.

When the operational manipulator 30 is placed in its advanced position as shown in FIG. 4*a*, the toothed rim 36 of the drive sleeve 35 is in engagement with the second toothed rim 55 of the power-transmission unit 50.

In this position, the main-manipulator drive rime 37 is disengaged from the receiving rim 27 of the main manipulator 20, and, consequently, a torque from the main motor 70 will be transmitted to the operational manipulator 30 only.

From the description above, it will be understood that by controlling the axial position of the operational manipulator 30 in the housing 3, a torque from the power-transmission unit 50 may thus be transmitted to:

- the main manipulator 20 and the operational manipulator 30 in a first gear, thus from the first portion 52 of the power-transmission unit 50 as shown in FIGS. 1*a*, 2*a* and 3*a*; or
- the operational manipulator 30 only, in a second gear, thus from the second portion 54 of the power-transmission unit 50 as shown in FIG. 4*a*.

By the very fact of the first portion 52 of the power-transmission unit 50 rotating at a different number of revolutions from that of the second portion 54, the power-transmission unit 50 is provided with a portion not transmitting power or free portion 56 with a smooth surface, the free portion 56 being arranged between the first toothed rim 53 and the second toothed rim 55. The axial extent of the free portion 56 is at least as large as the axial extent of the internal toothed rim 36 of the operational manipulator 30.

In the embodiment shown, the main-manipulator drive rim 37 is disengaged from the receiving rim 27 in the internal surface of the main manipulator 20 while, at the same time, the internal toothed rim 36 of the operational manipulator 30 surrounds said free portion 56. Such a free position will occur when the operational manipulator 30 is moved from the axial position that is shown in FIG. 3*a* to the axial position that is shown in FIG. 4*a*.

In connection with the "retraction" of the operational manipulator 30 from the position that is shown in FIG. 4*a* or 5 to the position that is shown in FIG. 3*a*, it is conceivable that the main-manipulator drive rim 37 will hit (align with) the toothed rim 53 of the first portion 52 of the power-transmission unit 50. This may prevent further retraction. To avoid such a situation, the drive sleeve 42 is provided with a pre-tensioning device which, in the embodiment shown, is a spring 43. The spring 43 is tensioned when the operational manipulator 30 is in the advanced position. If the manipulator drive rim 37 hits said toothed rim 53, the retraction is temporarily stopped while the power-transmission portion 52 is brought to rotate. Because of the increased tensioning of the spring 43 in this situation, the manipulator drive rim 37 will be moved into the toothed rim 53 once these are not aligned with each other.

After the desired operation of the well device 120 has been performed by means of the operational manipulator 30, the gear motor 40 is reversed so that the toothed wheel 45 first pulls the operational manipulator 30 from its advanced position and in the direction of the second end portion 7 of the manipulation tool 1 (from the left to the right in the figures). As the carrier-block groove 34 of the operational manipulator 30 is moved past the carrier blocks 23, the carrier blocks 23 will be driven into engagement with the carrier-block groove 34. By further retraction of the operational manipulator 30, an axial movement in the direction of the second end portion 7 of the manipulation tool 1 will be imparted to the main manipulator 20 as well. As the main manipulator 20 is placed in its retracted position, the latches 14 of the gripping device 10 will be driven radially outwards, thus undoing the axial engagement of the manipulation tool 1 with the well device 120. The manipulation tool 1 may then be pulled out of the well or any other bore in which it may be positioned.

However, the above-mentioned retraction requires the gear motor 40 and its connection to the operational manipulator 30 to be fully operative so that the operational manipulator 30 and the main manipulator 20, too, may be brought to their retracted position.

If a situation should arise in which, for example, the gear motor 40 is not functioning, the manipulation tool 1 cannot be pulled out of engagement from the well device 120 without extensive damage to one or both of the well device 120 and the manipulation tool 1. This is because of the mechanically locked engagement of the latches 14 with the well device 120. For example, a person skilled in the art will know that damage to a well device of the well-packer type is potentially very serious.

To be able to ensure a controlled and safe pull-out of the manipulation tool 1 even in a situation in which the main manipulator 20 cannot be brought to its retracted position as shown in FIG. 1*a*, the manipulation tool 1 is provided with a safety mechanism which is activated by means of an impact against the second end portion 7 of the manipulation tool 1. When the manipulation tool 1 is used in a well, the impact will typically be effected by means of an impacting pipe, a so-called jar.

The safety mechanism will be explained in what follows, with reference to the FIGS. 2*c*, 4*a*, 5, 6*a* and 6*b*.

A portion of the housing 3 includes an outer housing portion 300 which overlaps a portion of an inner housing portion 302. The housing portions 300, 302 are axially connected to each other by means of breakable fastening means which, in the embodiment shown, comprise at least one shear screw 304, which is seen best in FIG. 2*c*.

The housing 3 is further provided with an external jacket that comprises a plurality of sleeve elements 306 arranged in series. At least two of the sleeve elements 306 are arranged with an axial distance D as shown in FIG. 4*a* among others.

Figure 7:
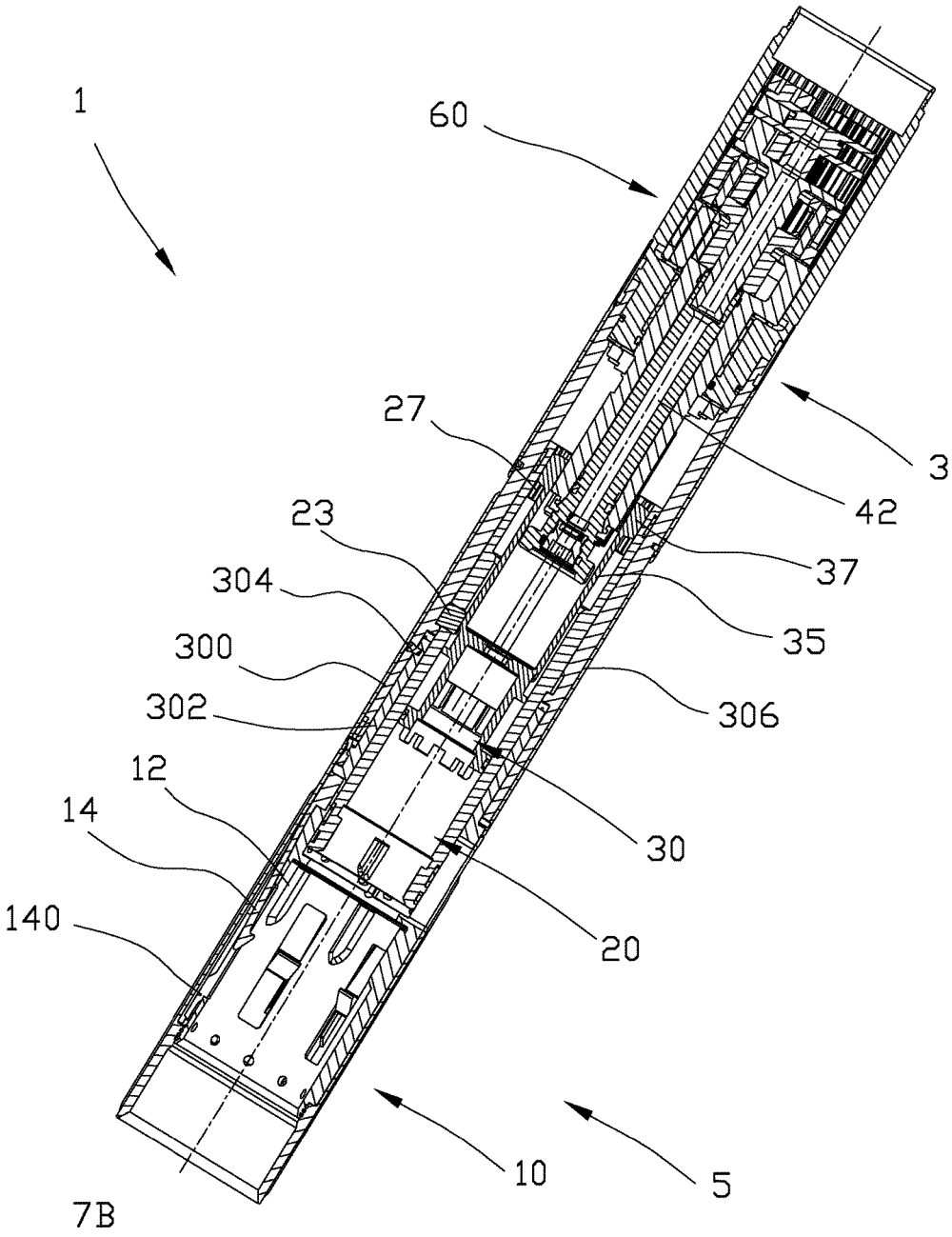
FIG. 7 shows a cross-sectional view, on a larger scale, taken through a portion of the longitudinal axis of the manipulation tool.
Figure 8:
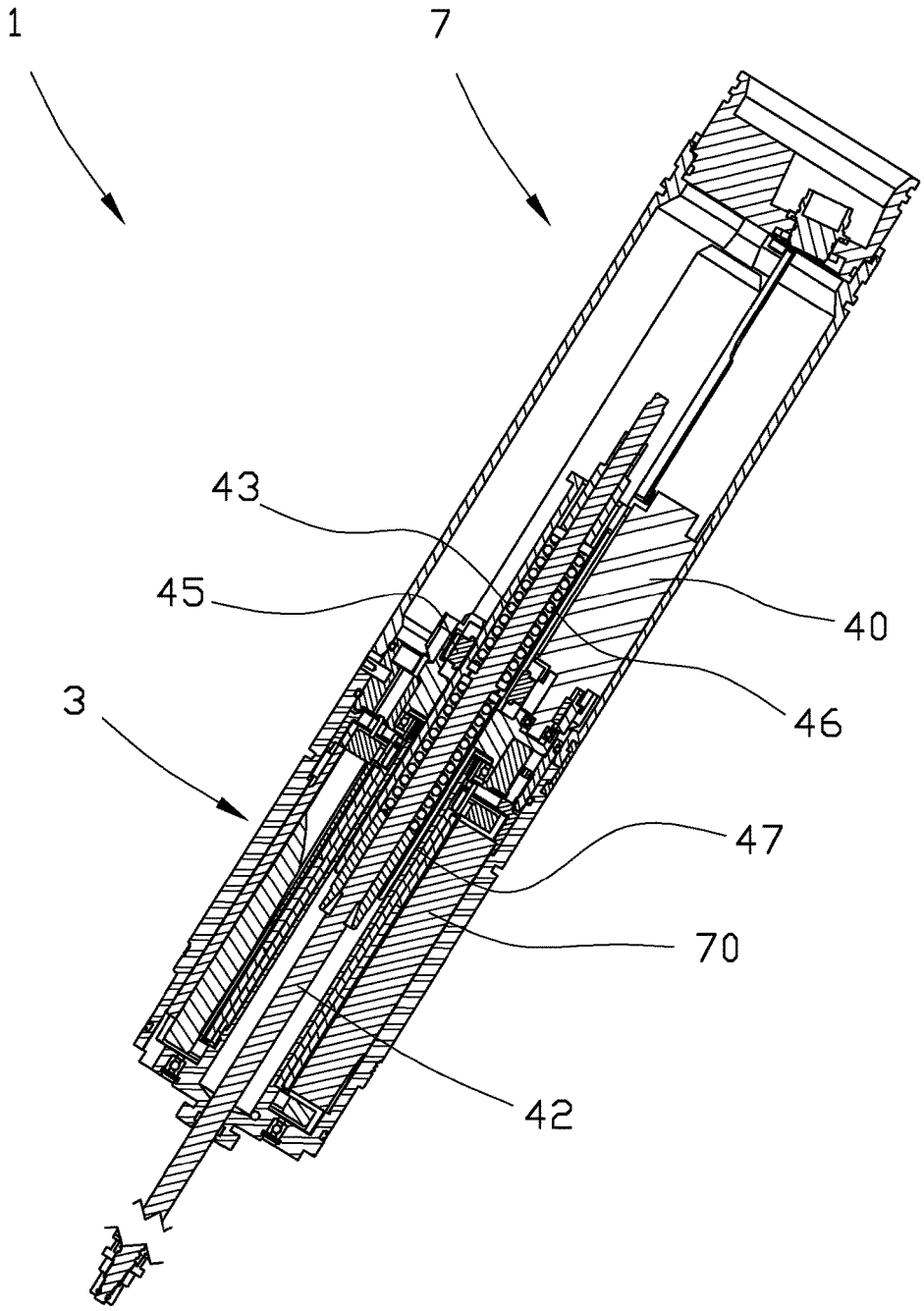
FIG. 8 shows a cross-sectional view taken through a portion of the longitudinal axis of the manipulation tool on a larger scale.

Further, the inner housing portion 302 is axially connected to an end portion of the latches 14 as is shown in FIG. 7 among others.

As mentioned previously, the radial position of the latches 14 is determined by the axial position of the latches 14 relative to the guideways 140 defined between the paired guiding elements 142, and each of the guiding elements 142 is connected to the main manipulator 20 so that the guiding elements 142 follow the axial movement of the main manipulator 20.

FIG. 5 shows the manipulation tool 1 just after an external impact force has been applied to the second end portion 7 in an axial direction towards the first end portion 5. The impact force may, for example, be supplied by means of a jar as mentioned above. Such a jar and the operation thereof will be known to a person skilled in the art and will therefore not be described any further.

Figure 6A:
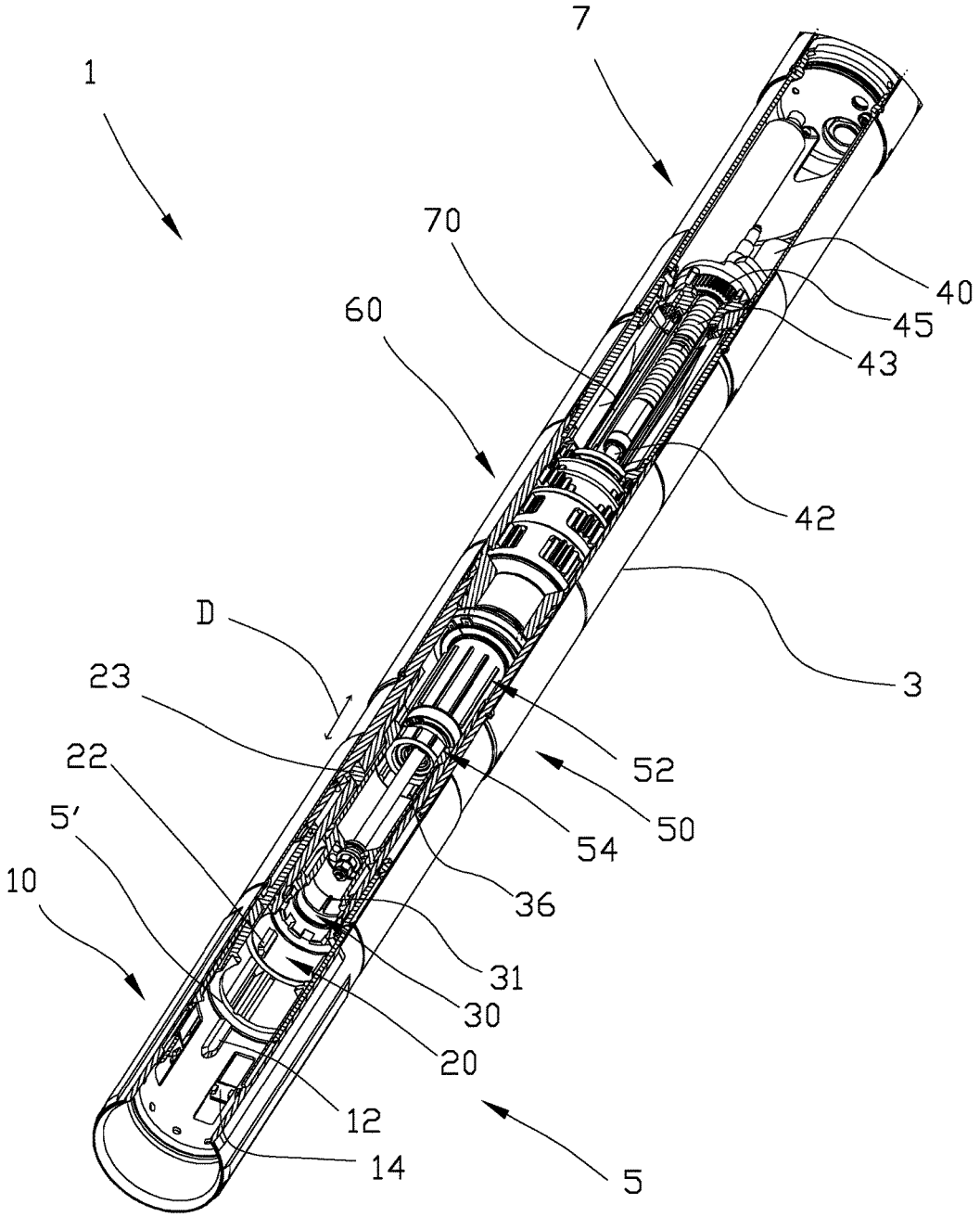

The impact force has resulted in the at least one shear screw 304 being broken and the axial distance D between the sleeve elements 306 being reduced from the distance shown in FIG. 4*a* to the distance shown in FIG. 5. After the shear screw 304 has been broken, the outer housing portion 300 is allowed to be moved axially a limited distance relative to the inner housing portion 302, as is shown in FIG. 6*a*. The movement shown has been brought about by the manipulation tool 1 having been subjected to an outer pulling force delivered to the second end portion 7 of the housing 3, for example from a pulling tool (not shown) aboard a rig.

Figure 6B:
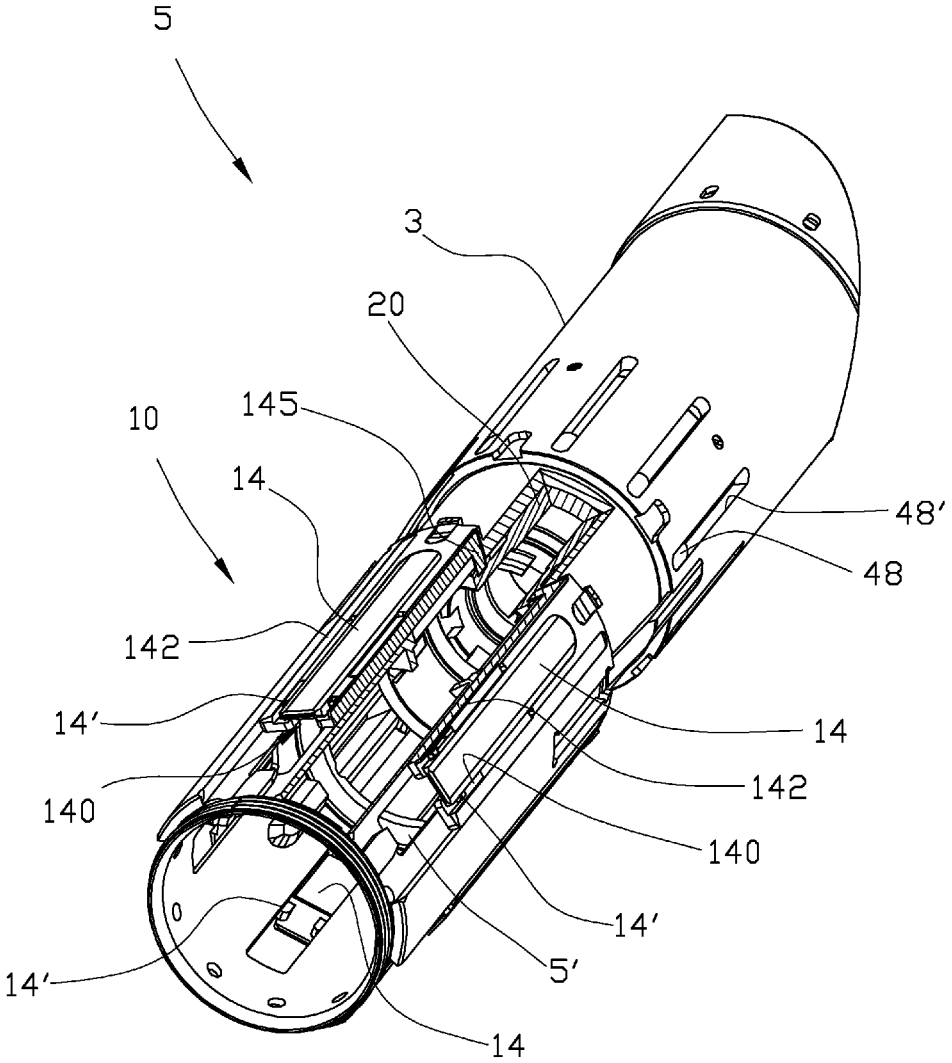

To prevent relative motion between the inner housing portion 302 and the outer housing portion 300, the inner housing portion 302 is provided with anti-rotation lugs 48 projecting into anti-rotation slots 48' arranged in the outer housing portion 300. As shown in FIGS. 1*b*, 2*b*, 3*b*, 4*b* and 6*b*, the extent of the anti-rotation slots 48' in the longitudinal direction of the tool is larger than the extent of the lugs 48. An axial movement is thereby allowed between the inner housing portion 302 and the outer housing portion 300 after the shear screw 304 has been broken. The lugs 48 and the slots 48' additionally help to carry the lower portion of the tool after the shear screw 304 has been broken. This is shown in FIG. 6*b*, where the lugs 48 abut against the end portions of the slots 48'.

The main manipulator 20 is connected to the outer housing portion 300 by the carrier block 23 being in engagement with the carrier-block-receiving groove 24 which is formed in the outer housing portion 300. An axial displacement of the outer housing portion 300 will thus lead to a corresponding displacement of the main manipulator 20. Accordingly, there will be relative motion between the latches 14 and the guideways 140 as well, and the latches 14 are brought to the retracted position as shown in FIG. 6*b*, so that the engagement between the manipulation tool 1 and the well device 120 comes to an end. The manipulation tool 1 can now be pulled out of, for example, a well.

The only "damage" done to the manipulation tool 1 in consequence of the activation of the safety mechanism is the induced breaking of the shear screw 304. The well device 120 from which the manipulation tool 1 has been disconnected will not be exposed to undue loads in consequence of the activation of the safety mechanism of the manipulation tool 1 either.

FIGS. 10*a*-10*c* show an adapter 400 according to the second aspect of the invention. The adapter 400 includes an elongated housing 402 with a first end portion 404 and a second end portion 406.

The adapter 400 of the exemplary embodiment shown in FIGS. 10*a*-10*c* is well suited for connection to any well device used in connection with the installation of a straddle packer (zone-isolation packer), the opening or closing of valves, and the setting or pulling of plugs, which are all operated by means of axial forces. Thus, the advantages of the manipulation tool 1 may be utilized even for conventional equipment that is based on operation by means of axial movement.

The adapter 400 is provided with a coupling means which, in the embodiment shown, is a fishing neck 410 which includes a fishing-neck groove 411 and a shoulder 411'. The fishing-neck groove 411 is arranged to receive the latches 14 of the manipulation tool 1, whereas the shoulder 411' prevents axial movement of the latches 14 out of the fishing-neck groove 411 as long as the latches 14 abut against the fishing-neck groove 411.

The adapter 400 is further provided with a coupling means 421 which complementarily fits the holding lugs 12 of the manipulation tool 1, and a manipulator-coupling means 413 which complementarily fits the engagement means 22 of the main manipulator 20.

The adapter 400 includes a shaft 412 which is arranged in the first end portion 404 of the housing 402. In the embodiment shown, the shaft 412 extends approximately from the middle portion of the housing 402 and to some distance out of the first end portion 404 of the housing 402. The shaft 412 is arranged to be set into rotation by means of the main manipulator 20 of the manipulation tool 1 when it is in the position that is shown in FIG. 3*a*.

To allow rotation, but no axial movement of the shaft 412, this is provided with annular cams 420 (five shown) projecting from the surface of the shaft 412 and being spaced apart along the longitudinal axis of the shaft 412. The annular cams 420 complementarily fit the groove 422 arranged in the internal surface of the housing 402.

The adapter 400 further includes a rod 414 which is arranged in the second end portion 406 in the housing 402. The rod 414 extends, in the embodiment shown, approximately from the middle portion of the housing 402. In FIG. 10*a*, the rod 414 projects some distance from the second end portion 406 of the housing 402 and terminates in a well-tool-coupling means 416 which, in the embodiment shown, is shown as a shear pin which has been screwed into an end portion of the rod 414.

To allow axial movement, but not rotational motion of the rod 414, it is provided with splines 426 projecting from the surface of the rod 414 and extending parallel to the longitudinal axis of the housing 402. The splines 426 complementarily fit grooves 428 arranged in the internal surface of the housing 402, as shown in FIG. 10*c*.

A lower end portion of the shaft 412 is provided with a threaded portion which is arranged to be screwed together with a complementarily fitting threaded portion 418 in the rod 414. A rotation of the shaft 412 will result in the rod 414, and thereby the well-tool-coupling means 416, too, being subjected to an axial movement.

The adapter 400 may be attached to the well device, operated by axial force, with the help of means that will be well known to a person skilled in the art and therefore will not be described any further.

In FIG. 10*a*, the adapter is in an initial position in which the threaded portion of the shaft 412 is barely in engagement with the threaded portion 418 of the rod 414. In FIG. 10*a*, the rod 414 is in its most projecting position relative to the second end portion 406 of the housing 402.

FIG. 10*b* shows the adapter 400 after the shaft 412 has been subjected to a certain number of rotations by means of the manipulation tool 1 according to the first aspect of the invention so that the shaft 412 has been screwed further into the threaded portion 418 of the rod 414 and has pulled this in the direction of the first end portion 404 of the adapter, and after the operation of the well device operated by axial force (not shown) has been completed and after a further rotation of the manipulation tool 1 has resulted in the breaking of the shear pin 416. Such a force may typically be in the order of 90-180 kN (20,000-40,000 lbs). The connection between the adapter 400 and the well device operated by axial force is now broken and the adapter 400 may be pulled out of the well by means of the manipulation tool 1.

It should be emphasised that before the shear pin 416 has been broken, the manipulation tool 1 may be released from the adapter 400 any time by releasing the latches 14 of the manipulation tool 1 from engagement with the fishing neck 410 of the adapter 400, as explained earlier under the description of how the engagement means 10 of the manipulation tool 1 may be controlled.

By means of the adapter 400, the advantages of the manipulation tool 1 relative to other activation tools may also be used on well devices that are controlled by means of axial forces. Such well devices may be, for example, but are not limited to, a valve, a straddle packer or a plug.

The invention claimed is:

1. A manipulation tool (1) for connection to and operation of a controllable well device (120), the manipulation tool (1) comprising:

an elongated housing (3) with a first end portion (5) and a second end portion (7);

a gripping device (10) arranged in the first end portion (5) of the housing (3), the gripping device (10) being configured to provide a releasable engagement with the well device (120) that is to be controlled by means of the manipulation tool (1), the gripping device (10) comprising means (12, 14) for resisting rotational and axial movement between the housing (3) and the well device;

at least one manipulation device (20, 30) which is axially displaceable between a first position and a second position along a longitudinal axis of the housing (3) and rotatable around a longitudinal axis of the housing (3);

a first driving device (40) to produce axial displacement of the at least one manipulation device (20, 30);

a second driving device (70) to produce rotation of the at least one manipulation device (20, 30); and wherein the first driving device and the second driving device are connected to a control unit (80) arranged to control an energy supply to the driving devices.

2. The manipulation tool according to claim 1, wherein the means (12) of the gripping device (10) of resisting rotational motion between the housing (3) and the well device are independent of the means (14) of the gripping device (10) of resisting axial movement between the housing (3) and the well device.

3. The manipulation tool according to claim 1, wherein the means (14) of the gripping device (10) of resisting axial movement between the housing (3) and the well device include a radially movable locking device (14) arranged to be moved between a first position, in which the locking device (14) is disengaged from a portion of the well device, and a second position, in which the locking device (14) is in radially locking engagement with the well device.

4. The manipulation tool according to claim 3, wherein the radial position of the locking device (14) is determined by an axial position of one of the at least one manipulation device (20).

5. The manipulation tool according to claim 4, wherein the locking device (14) is held axially fixed to a portion of the housing (3), wherein the radial position of the locking device is controlled by a guiding portion (140) whose axial position is determined by the axial position of one of the at least one manipulation device (20).

6. The manipulation tool according to claim 3, wherein a portion of the housing (3) includes an outer housing portion (300) overlapping a portion of an inner housing portion (302), wherein a breakable fastening means (304) is arranged for holding against axial movement between the inner and out housing portions (300, 302), as the inner housing portion (302) is axially connected to an end portion of the locking device (14), and the outer housing portion (300) is axially connected to the manipulation device (20), so that a breaking of the breakable fastening means (304) will allow relative motion between the outer housing portion (300) and the inner housing portion (302) and thereby also between latches (14) and a guiding portion (140).

7. The manipulation tool according to claim 1, wherein the second driving device (70) is connected to the at least one manipulation device (20, 30) via a power-transmission unit (50) which is provided with a power-transmission means (53, 55) which is complementarily adapted to a power-receiving portion (27, 36) arranged in the at least one manipulation device (20, 30).

8. The manipulation tool according to claim 7, wherein the power-transmission unit (50) includes a first portion (52)

and at least one second portion (54) arranged in series in an axial direction of the power-transmission unit (50), at least one of the first portion (52) and the second portion (54) being provided with a portion (56) not transmitting power.

9. The manipulation tool according to claim 1, wherein the at least one manipulation device (20, 30) is connected to the second driving device (70) via a gear (60).

10. The manipulation tool according to claim 1, wherein the at least one manipulation device (20, 30) includes two or more manipulation devices arranged coaxially.

11. The manipulation tool according to claim 1, wherein the control unit (80) is arranged in the second end portion (7) of the housing (3).

12. The manipulation tool according to claim 1, wherein at least the first driving device (40) is an electromotor.

13. The manipulation tool according to claim 1, wherein at least the second driving device (70) is a fluid-driven motor.

14. An adapter (400) for use between the manipulation tool (1) according to claim 1 and a well tool operated by means of an axial force, the adapter (400) comprising:

an elongated housing (402) with a first end portion (404) and a second end portion (406);

a coupling means (410) arranged to receive the gripping device (10) of the manipulation tool (1), the coupling means (410) being arranged in the first end portion (404) of the housing (402);

a shaft (412) arranged in the first end portion (404) of the housing (402), the shaft (412) being arranged to receive a torque from one of the at least one manipulation device (20, 30) of the manipulation tool (1), and the shaft (412) being held fixed against axial movement along a longitudinal axis of the housing (402);

an rod (414) arranged to be moved in an axial direction in the second end portion (406) of the housing (402), the rod (414) being held fixed against rotation relative to the housing (402), and the rod (414) being provided with a well-tool-coupling means (416) for connection to a well tool, the shaft (412) being provided with a threaded portion which is arranged to be screwed together with a complementarily fitting threaded portion (418) of the rod (414), so that a rotation of the shaft (412) will result in an axial movement of the rod (414) and the well-tool-coupling means (416).

15. A method of manipulating a well tool, said method comprising the steps of:

bringing a manipulation tool into contact with a well tool (120, 400), the manipulation tool having an elongated housing (3) with a first end portion (5) and a second end portion (7); a gripping device (10) in the first end portion (5) of the housing (3) being configured to provide a releasable engagement with the well device (120) controllable by means of the manipulation tool (1), the gripping device (10) comprising means (12, 14) for resisting rotational and axial movement between the housing (3) and the well device; at least one manipulation device (20, 30) axially displaceable between a first position and a second position along a longitudinal axis of the housing (3) and rotatable around a longitudinal axis of the housing (3); a first driving device (40) to produce axial displacement of the at least one manipulation device (20, 30); a second driving device (70) to produce rotation of the at least one manipulation device (20, 30); and wherein the first and second driving devices are connected to a control unit (80) arranged to control an energy supply to the driving devices;

activating the first driving device in order to: releasably engage a gripping device (10) with a coupling means (123; 410) arranged at an end portion of the well tool (120, 400); and axially displace at least one rotatable manipulation device into engagement with a portion of the well tool; and activating the second driving device by means of a control device in order to provide a desired rotation of one of the at least one manipulation device, the rotation being transmitted to a rotatable element (122, 131; 413) in the well tool (120, 400).

16. The method according to claim 15, wherein the well tool is a well device selected from the group of: a valve, a plug or a combination of these.

17. The method according to claim 15, wherein the well tool is an adapter (400) comprising an elongated housing (402) with a first end portion (404) and a second end portion (406);

a coupling means (410) for receiving the gripping device (10) of the manipulation tool (1), the coupling means arranged in the first end portion (404) of the housing (402);

a shaft (412) in the first end portion (404) of the housing (402), the shaft (412) receives a torque from at least one manipulation device (20, 30) of the manipulation tool (1) and is held fixed against axial movement along a longitudinal axis of the housing (402);

a rod (414) movable in an axial direction in the second end portion (406) of the housing (402) and held fixed against rotation relative to the housing (402), and the rod (414) has a well-tool-coupling means (416) for connection to the well tool, the shaft (412) has a threaded portion arranged to be screwed together with a complementarily fitting threaded portion (418) of the rod (414) so that a rotation of the shaft (412) results in an axial movement of the rod (414) and the well-tool-coupling means (416).

18. The method according to claim 15, wherein the method further, after the desired rotation of the manipulation device has been carried out, includes the following steps:

activating the first driving device again in order to:

disengage the at least one rotatable manipulation device from the well tool; and carry the manipulation tool (1) away from the well tool.

19. A method of manipulating a well device operable by axial force by using the manipulation tool according to claim 1, the method including:

fitting an adapter to the well device operable by axial force, the adapter having an elongated housing with the first end portion and the second end portion; a coupling means for receiving the gripping device and arranged in the first end portion of the housing; a shaft arranged in the first end portion of the housing and arranged to receive a torque from at least one manipulation device, the shaft held fixed against axial movement along a longitudinal axis of the housing; a rod arranged to be moved in an axial direction in the second end portion of the housing, the rod held fixed against rotation relative to the housing, and the rod provided with a well-tool-coupling means for connection to a well tool, the shaft provided with a threaded portion arranged for screwing together with a complementarily fitting threaded portion of the rod, so that a rotation of the shaft results in an axial movement of the rod and the well-tool-coupling means;

bringing the manipulation tool into contact with the adapter (400);

activating the first driving device (40) to: releasably engage the gripping device (10) of the manipulation tool (1) with a coupling means (410) arranged at an end portion of the adapter (400); and displace at least one rotatable manipulation device (20, 30) of the manipulation tool (1) axially into engagement with a portion of the adapter (400); and activating the second driving device (70) by means of a control device in order to provide a desired rotation of one of the at least one manipulation device (20, 30), the rotation being transmitted to a rotatable element (412) in the adapter (400).

20. The method according to claim 19, wherein the method, after the desired rotation of the manipulation device (20, 30) has been carried out, further includes the step of: activating the first driving device (40) again in order to:

disengage the at least one rotatable manipulation device (20, 30) from the adapter (400); and carrying the manipulation tool (1) away from the adapter (400).

21. The method according to claim 19, wherein the method, after the desired rotation of the manipulation device (20, 30) has been carried out, further includes the steps of: continuing the rotation of the manipulation device (20, 30) so that a further axial force is transmitted from the adapter (400) to the well device until the engagement between the adapter (400) and the well device disintegrates; and carrying the manipulation tool (1) and the adapter (400) away from the well device.

* * * * *